US011641538B2

(12) United States Patent
Zhang et al.

(10) Patent No.: US 11,641,538 B2
(45) **Date of Patent: *May 2, 2023**

(54) SPEAKER DEVICE

(71) Applicant: SHENZHEN SHOKZ CO., LTD., Guangdong (CN)

(72) Inventors: Lei Zhang, Shenzhen (CN); Yongjian Li, Shenzhen (CN); Wenbing Zhou, Shenzhen (CN); Jinbo Zheng, Shenzhen (CN); Zhuyang Jiang, Shenzhen (CN); Xin Qi, Shenzhen (CN); Fengyun Liao, Shenzhen (CN)

(73) Assignee: SHENZHEN SHOKZ CO., LTD., Shenzhen (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/662,082

(22) Filed: May 5, 2022

(65) Prior Publication Data

US 2022/0264211 A1 Aug. 18, 2022

Related U.S. Application Data

(63) Continuation of application No. 17/169,604, filed on Feb. 8, 2021, now Pat. No. 11,363,362, which is a (Continued)

(30) Foreign Application Priority Data

Jun. 15, 2018 (CN) ..... 201810623408.2
Jun. 15, 2018 (CN) ..... 201810624043.5
Jan. 5, 2019 (CN) ..... 201910009909.6

(51) Int. Cl.
*H04R 25/00* (2006.01)
*H04R 1/10* (2006.01)
(Continued)

(52) U.S. Cl.
CPC ..... *H04R 1/1008* (2013.01); *H04R 1/105* (2013.01); *H04R 1/1025* (2013.01); (Continued)

(58) Field of Classification Search
CPC .... H04R 1/1016; H04R 1/44; H04R 2420/07; H04R 1/02; H04R 1/26; H04R 1/1075; (Continued)

(56) References Cited

U.S. PATENT DOCUMENTS 5,850,460 A 12/1998 Tanaka et al.
9,253,563 B2 2/2016 Fukuda
(Continued)

FOREIGN PATENT DOCUMENTS

CN 201215970 Y 4/2009
CN 202488645 U 10/2012
(Continued)

OTHER PUBLICATIONS

International Search Report in PCT/CN2019/070548 dated Mar. 25, 2019, 6 pages.
(Continued)

*Primary Examiner* — Amir H Etesam
(74) *Attorney, Agent, or Firm* — Metis IP LLC

(57) ABSTRACT

The present disclosure relates to a speaker device including a circuit housing, an ear hook, a rear hook, and a speaker assembly. The speaker assembly may include a headphone core and a housing for accommodating the headphone core, the housing may include a housing panel facing a human body and a housing back opposite to the housing panel, and the headphone core may cause the housing panel and the housing back to vibrate. An absolute value of a difference between a first phase of a vibration of the housing panel and a second phase of a vibration of the housing back may be less than 60 degrees when a frequency of each of the (Continued)

vibration of the housing panel and the vibration of the housing back is between 2000 Hz and 3000 Hz.

18 Claims, 16 Drawing Sheets

Related U.S. Application Data continuation-in-part of application No. 17/078,276, filed on Oct. 23, 2020, now Pat. No. 11,310,601, and a continuation-in-part of application No. 16/922,965, filed on Jul. 7, 2020, now Pat. No. 11,115,751, and a continuation-in-part of application No. PCT/CN2019/102382, filed on Aug. 24, 2019, which is a continuation of application No. PCT/CN2019/070545, filed on Jan. 5, 2019, which is a continuation of application No. PCT/CN2019/070548, filed on Jan. 5, 2019.

(51) Int. Cl.
*H04R 9/06* (2006.01)
*H04R 9/02* (2006.01)

(52) U.S. Cl.
CPC ..... *H04R 1/1041* (2013.01); *H04R 1/1075* (2013.01); *H04R 9/025* (2013.01); *H04R 9/06* (2013.01); *H04R 2460/13* (2013.01)

(58) Field of Classification Search
CPC ..... H04R 1/1091; H04R 1/1041; H04R 2460/13; H04R 1/1066; H04R 1/105
See application file for complete search history.

(56) References Cited

U.S. PATENT DOCUMENTS

| | | | | |
|---|---|---|---|---|
| 10,897,677 | B2 * | 1/2021 | Walraevens | H04R 25/606 |
| 11,310,601 | B2 | 4/2022 | Zheng et al. | |
| 2002/0196955 | A1 | 12/2002 | Boesen et al. | |
| 2009/0226017 | A1 | 9/2009 | Abolfathi et al. | |
| 2014/0185822 | A1 | 7/2014 | Kunimoto et al. | |
| 2014/0185837 | A1 | 7/2014 | Kunimoto et al. | |
| 2014/0355777 | A1 | 12/2014 | Nabata et al. | |
| 2015/0264473 | A1 | 9/2015 | Fukuda | |
| 2016/0234613 | A1 | 8/2016 | Westerkull | |
| 2016/0329041 | A1 | 11/2016 | Qi et al. | |
| 2017/0164088 | A1 | 6/2017 | Fukuda | |
| 2017/0295269 | A1 | 10/2017 | Hosoi et al. | |
| 2018/0160209 | A1 | 6/2018 | Ogata et al. | |
| 2019/0104352 | A1 | 4/2019 | Ozawa et al. | |
| 2021/0160632 | A1 | 5/2021 | Liao et al. | |
| 2021/0165249 | A1 | 6/2021 | Wang et al. | |
| 2021/0168489 | A1 | 6/2021 | Zhang et al. | |
| 2021/0268281 | A1 | 9/2021 | Johansson et al. | |
| 2021/0289285 | A1 | 9/2021 | Zheng et al. | |
| 2022/0225037 | A1 | 7/2022 | Liao et al. | |

FOREIGN PATENT DOCUMENTS

| | | | |
|---|---|---|---|
| CN | 105007551 | A | 10/2015 |
| CN | 105472511 | A | 4/2016 |
| CN | 106954152 | A | 7/2017 |
| CN | 207070281 | U | 3/2018 |
| CN | 107948883 | A | 4/2018 |
| CO | 12129395 | S | 10/2012 |
| EP | 2800395 | A1 | 11/2014 |
| GB | 2454605 | A | 5/2009 |
| JP | 2005080135 | A | 3/2005 |
| JP | 2009049844 | A | 3/2009 |
| JP | 2013102274 | A | 5/2013 |
| KR | 20100089353 | A | 8/2010 |
| KR | 20100106836 | A | 10/2010 |
| KR | 101849041 | B1 | 4/2018 |
| KR | 101910282 | B1 | 10/2018 |
| KR | 101934229 | B1 | 12/2018 |
| RU | 2359427 | C1 | 6/2009 |
| TW | 201820891 | A | 6/2018 |
| WO | 2007034739 | A1 | 3/2007 |

OTHER PUBLICATIONS

Written Opinion in PCT/CN2019/070548 dated Mar. 25, 2019, 7 pages.
International Search Report in PCT/CN2019/070545 dated Apr. 10, 2019, 6 pages.
Written Opinion in PCT/CN2019/070545 dated Apr. 10, 2019, 8 pages.
International Search Report in PCT/CN2019/102382 dated Nov. 22, 2019, 7 pages.
Written Opinion in PCT/CN2019/102382 dated Nov. 22, 2019, 9 pages.
The Extended European Search Report in European Application No. 19819601.6 dated May 3, 2021, 10 pages.
The Extended European Search Report in European Application No. 19818634.8 dated Jun. 15, 2021, 14 pages.
Decision on Grant in Russian Application No. 2021100591 dated Jul. 5, 2021, 17 pages.
The Office Action in Russian Application No. 2021100590 dated Jul. 15, 2021, 12 pages.
First Examination Report in Indian Application No. 202017054479 dated Dec. 20, 2021, 5 pages.
Notice of Preliminary Rejection in Korean Application No. 10-2021-7000929 dated Jan. 25, 2022, 13 pages.
Notice of Reasons for Rejection in Japanese Application No. 2020569946 dated Feb. 21, 2022, 10 pages.
Notice of Reasons for Rejection in Japanese Application No. 2020569945 dated Feb. 21, 2022, 9 pages.
Decision of Patent Grant in Korean Application No. 10-2021-7001172 dated Apr. 27, 2022, 3 pages.
Anonymous, Tech Note: Understanding Exciters—Principles and Applications, Dayton Audio, 2014, 8 pages.

* cited by examiner

SPEAKER DEVICE

CROSS-REFERENCE TO RELATED APPLICATIONS

This application is a continuation of U.S. patent application Ser. No. 17/169,604, filed on Feb. 8, 2021, which is a continuation-in-part application of International Patent Application No. PCT/CN2019/102382, filed on Aug. 24, 2019, which claims priority of Chinese Patent Application No. 201910009909.6, filed on Jan. 5, 2019; U.S. patent application Ser. No. 17/169,604 is also a continuation-in-part application of U.S. patent application Ser. No. 16/922,965, filed on Jul. 7, 2020 (now U.S. Pat. No. 11,115,751), which is a continuation of International Patent Application No. PCT/CN2019/070545, filed on Jan. 5, 2019, which claims priority of Chinese Patent Application No. 201810624043.5, filed on Jun. 15, 2018; and U.S. patent application Ser. No. 17/169,604 is also a continuation-in-part application of U.S. patent application Ser. No. 17/078,276, filed on Oct. 23, 2020 (now U.S. Pat. No. 11,310,601), which is a continuation of International Patent Application No. PCT/CN2019/070548, filed on Jan. 5, 2019, which claims priority of Chinese Patent Application No. 201810623408.2, filed on Jun. 15, 2018. The contents of each of the above applications are hereby incorporated in their entireties by reference.

TECHNICAL FIELD

The present disclosure relates to the field of speaker devices, and in particular, to a button of a speaker device.

BACKGROUND

A speaker assembly of a speaker device on the market may include a button and an auxiliary button to facilitate a user of the speaker device to perform corresponding functions. The user can implement corresponding functions (e.g., pausing/playing music, answering a call, etc.) through the button and the auxiliary button. However, the setting of the button or the auxiliary button may affect the working state of the speaker assembly. For example, the button may reduce the volume generated by the speaker assembly.

SUMMARY

According to an aspect of the present disclosure, a speaker device is provided. The speaker device may include a circuit housing, an ear hook, a rear hook, and a speaker assembly. The circuit housing may be configured to accommodate a control circuit or a battery. The ear hook may be connected to a first end of the circuit housing, and a first housing sheath may cover at least a portion of the ear hook. The rear hook may be connected to a second end of the circuit housing. A second housing sheath may cover at least a portion of the rear hook. The first housing sheath and the second housing sheath may cover at least a portion of an external surface of the circuit housing, from the first end of the circuit housing and the second end of the circuit housing, respectively, in a sleeved manner. The speaker assembly may be connected to an end of the ear hook. The speaker assembly may include a headphone core and a housing for accommodating the headphone core. The housing may include a housing panel facing a human body and a housing back opposite to the housing panel. The headphone core may cause the housing panel and the housing back to vibrate. A vibration of the housing panel may have a first phase, a vibration of the housing back may have a second phase, and an absolute value of a difference between the first phase and the second phase may be less than 60 degrees when a frequency of each of the vibration of the housing panel and the vibration of the housing back is between 2000 Hz and 3000 Hz.

In some embodiments, the circuit housing may include a first side wall, a second side wall, and an end wall, each two of the first side wall, the second side wall, and the end wall may be connected, and the first housing sheath and the second housing sheath may be connected on the first side wall and the second side wall, respectively.

In some embodiments, an inner surface of the first housing sheath or the second housing sheath corresponding to the first side wall may include at least one positioning protrusion, and a positioning groove may be disposed on an outer surface of the main side wall. The positioning groove may correspond to the at least one position protrusion.

In some embodiments, the at least one positioning protrusion may be arranged with a strip shape and arranged obliquely relative to the second side wall.

In some embodiments, a connection area of the first housing sheath and the second housing sheath on the first side wall and the second side wall may be inclined relative to the second side wall.

In some embodiments, an area of the circuit housing covered by one of the first housing sheath and the second housing sheath may be not less than an area of the circuit housing covered by the other one of the first housing sheath and the second housing sheath.

In some embodiments, the rear hook may further include a plug end facing to the circuit housing. The second housing sheath may sleeve at least a portion of the plug end. The circuit housing may include a socket facing to the rear hook. At least a portion of the plug end may be inserted into the socket. The plug end may include a slot, and the slot may be vertical to an insertion direction of the socket. A first side wall of the socket may include a first through hole corresponding to the slot. The speaker device may further include a fixing component. The fixing component may include two pins and a connection unit. The two pins may be parallel to each other, and the connection unit may be configured to connect the two pins. The two pins may pass through the first through hole from outside of the plug end and be inserted into the slot such that the plug end may be inserted into and fixed with the socket.

In some embodiments, a second side wall of the socket may be opposite to the first side wall of the socket. The second side wall of the socket may include a second through hole. The second through hole may be opposite to the first through hole. The two pins may pass through the slot and be inserted into the second through hole.

In some embodiments, the plug end may include a first plug unit and a second plug unit. A cross section area of the first plug unit may be greater than a cross section area of the second plug unit in a cross-sectional direction perpendicular to the insertion direction of plug end. The slot may be disposed on the second plug unit, and the second plug unit may be disposed in the socket.

In some embodiments, the first plug unit may include a first wiring groove disposed along the insertion direction of the socket. The second plug unit may include a second wiring groove, and the second wiring groove may be penetrated. A third wiring groove may be disposed on an inner side wall of the socket. A first end of the third wiring groove may be connected to the first wiring groove. A second end of the third wiring groove may be connected to the second wiring groove. The speaker device may further include a wire. The wire may pass through the first wiring groove, the third wiring groove, and the second wiring groove in sequence from the rear hook and be connected to the control circuit or the battery.

In some embodiments, the vibration of the housing panel may have a first amplitude, the vibration of the housing back may have a second amplitude, and a ratio of the first amplitude to the second amplitude may be within a range of 0.5 to 1.5.

In some embodiments, the vibration of the housing panel may generate a first sound leakage wave, the vibration of the housing back may generate a second sound leakage sound wave, and the first sound leakage wave and the second sound leakage wave may have an overlap, which may reduce an amplitude of the first sound leakage wave.

In some embodiments, the housing panel and one or more other components of the housing may be connected via at least one of a bonding connection, a snaping connection, a welding connection, or a threaded connection.

In some embodiments, at least one of the housing panel or the housing back may be made of fiber reinforced plastic material.

In some embodiments, the vibration caused by the headphone core may generate a driving force. The housing panel may be connected to the headphone core via a transmission connection mode. At least a portion of the housing panel may be connected or against the human body such that a sound is conducted. An area of the housing panel contacted or against the human body may include a normal line. A line where the driving force locates may be not parallel to the normal line.

In some embodiments, a positive direction of the line where the driving force locates may be set outwards the speaker device from the housing panel. A positive direction of the normal line may be set outwards the speaker device. An angle formed between the line where the driving force locates along the positive direction of the line and the normal line along the positive direction of the normal line may be an acute angle.

In some embodiments, the headphone core may include a coil and a magnetic circuit component. Axes of the coil and the magnetic circuit component may be not parallel to the normal line. The axes of the coil and the magnetic circuit component may be perpendicular to a radial plane of the coil or a radial plane of the magnetic circuit component.

In some embodiments, the driving force may have a component in a first quadrant and/or a third quadrant of an XOY plan coordinate system. The origin of the XOY plan coordinate system may be located on a contact surface between the speaker device and the human body. An X-axis of the XOY plan coordinate system may be parallel to a coronal axis of the human body. A Y-axis may be parallel to a sagittal axis of the human body. A positive direction of the X-axis may face outside of the human body. A positive direction of the Y-axis may face the front of the human body.

In some embodiments, the area of the housing panel connected or against the human body may include a plane or a quasi-plane.

In some embodiments, the headphone core may further include a magnetic circuit assembly. The magnetic circuit assembly may generate a first magnetic field. The magnetic circuit assembly may include a first magnetic element, a first magnetically conductive element, and at least one second magnetic element. The first magnetic element may generate a second magnetic field. The at least one second magnetic element may surround the first magnetic element. A magnetic gap may be formed between the first magnetic element and the at least one second magnetic element. An intensity of the first magnetic field in the magnetic gap may be greater than an intensity of the second magnetic field in the magnetic gap.

In some embodiments, the speaker device may further include a second magnetically conductive element and at least one third magnetic element. The at least one third magnetic element may be connected to the second magnetically conductive element and the at least one second magnetic element.

In some embodiments, the speaker device may further include at least one fourth magnetic element. The at least one fourth magnetic element may be disposed below the magnetic gap and connected to the first magnetic element and the second magnetically conductive element.

In some embodiments, the speaker device may further include at least one fifth magnetic element. The at least one fifth magnetic element may be connected to an upper surface of the first magnetically conductive element.

In some embodiments, the speaker device may further include a third magnetically conductive element. The third magnetically conductive element may be connected to an upper surface of the fifth magnetic element and configured to suppress field intensity leakage of the first magnetic field.

In some embodiments, the first magnetically conductive element may be connected to an upper surface of the first magnetic element. The second magnetically conductive element may include a bottom plate and a side wall. The first magnetic element may be connected to the bottom plate of the second magnetically conductive element.

In some embodiments, the speaker device may further include at least one conductive element. The at least one conductive element may be connected to at least one of the first magnetic element, the first magnetically conductive element, or the second magnetically conductive element.

Additional features will be set forth in part in the description which follows, and in part will become apparent to those skilled in the art upon examination of the following and the accompanying drawings or may be learned by production or operation of the examples. The features of the present disclosure may be realized and attained by practice or use of various aspects of the methodologies, instrumentalities and combinations set forth in the detailed examples discussed below.

BRIEF DESCRIPTION OF THE DRAWINGS

The present disclosure is further described in terms of exemplary embodiments. These exemplary embodiments are described in detail with reference to the drawings. These embodiments are non-limiting exemplary embodiments, in which like reference numerals represent similar structures throughout the several views of the drawings, and wherein.

DETAILED DESCRIPTION

Figure 1:
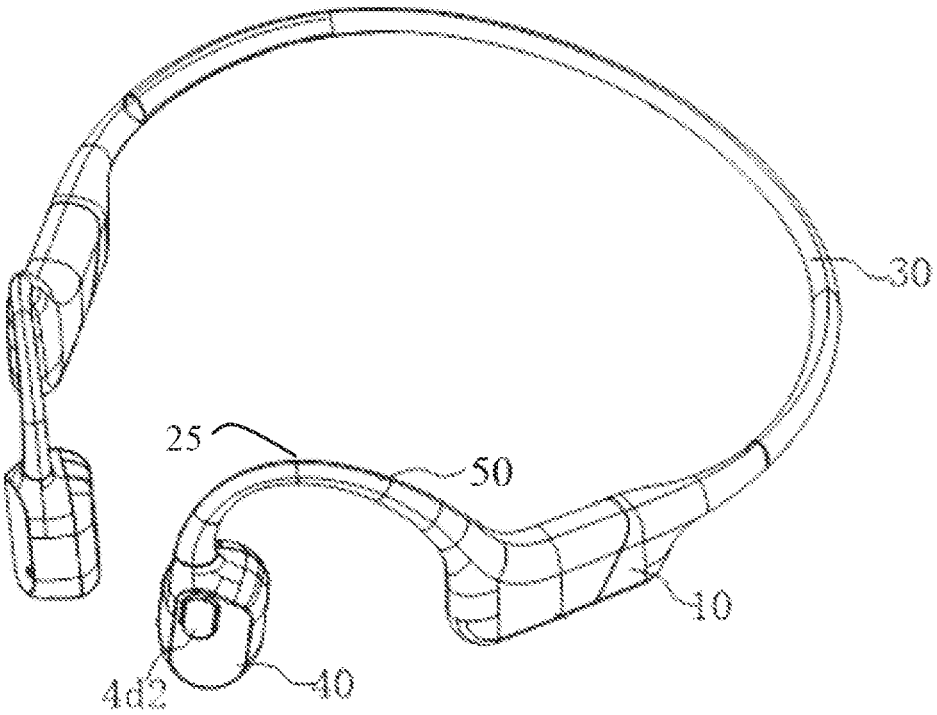
FIG. 1 is a schematic diagram illustrating an exemplary speaker device according to some embodiments of the present disclosure.

In order to illustrate the technical solutions related to the embodiments of the present disclosure, a brief introduction of the drawings referred to in the description of the embodiments is provided below. Obviously, drawings described below are only some examples or embodiments of the present disclosure. Those skilled in the art, without further creative efforts, may apply the present disclosure to other similar scenarios according to these drawings. It should be understood that the purposes of these illustrated embodiments are only provided to those skilled in the art to practice the application, and not intended to limit the scope of the present disclosure. Unless apparent from the locale or otherwise stated, like reference numerals represent similar structures or operations throughout the several views of the drawings.

As used in the disclosure and the appended claims, the singular forms "a," "an," and/or "the" may include plural forms unless the content clearly indicates otherwise. In general, the terms "comprise," "comprises," and/or "comprising," "include," "includes," and/or "including," merely prompt to include steps and elements that have been clearly identified, and these steps and elements do not constitute an exclusive listing. The methods or devices may also include other steps or elements. The term "based on" is "based at least in part on." The term "one embodiment" means "at least one embodiment". The term "another embodiment" means "at least one other embodiment". Related definitions of other terms will be provided in the descriptions below. In the following, without loss of generality, the description of "speaker device" or "speaker" will be used when describing the speaker related technologies in the present disclosure. This description is only a form of speaker application. For a person of ordinary skill in the art, "speaker device", "speaker", or "earphone" can also be replaced with other similar words, such as "player", "hearing aid", or the like. In fact, various implementations in the present disclosure may be easily applied to other non-loudspeaker-type hearing devices. For example, for professionals in the field, after understanding the basic principles of the speaker device, multiple variations and modifications may be made on forms and details of the specific methods and steps for implementing the speaker device, in particular, an addition of ambient sound pickup and processing functions to the speaker device so as to enable the speaker device to function as a hearing aid, without departing from the principle. For example, a sound transmitter such as a microphone may pick up an ambient sound of the user/wearer, process the sound using a certain algorithm, and transmit the processed sound (or a generated electrical signal) to the user/wearer. That is, the speaker device may be modified and have the function of picking up ambient sound. The ambient sound may be processed and transmitted to the user/wearer through the speaker device, thereby implementing the function of a hearing aid. For example, the algorithm mentioned here may include a noise cancellation algorithm, an automatic gain control algorithm, an acoustic feedback suppression algorithm, a wide dynamic range compression algorithm, an active environment recognition algorithm, an active noise reduction algorithm, a directional processing algorithm, a tinnitus processing algorithm, a multi-channel wide dynamic range compression algorithm, an active howling suppression algorithm, a volume control algorithm, or the like, or any combination thereof.

Figure 2:
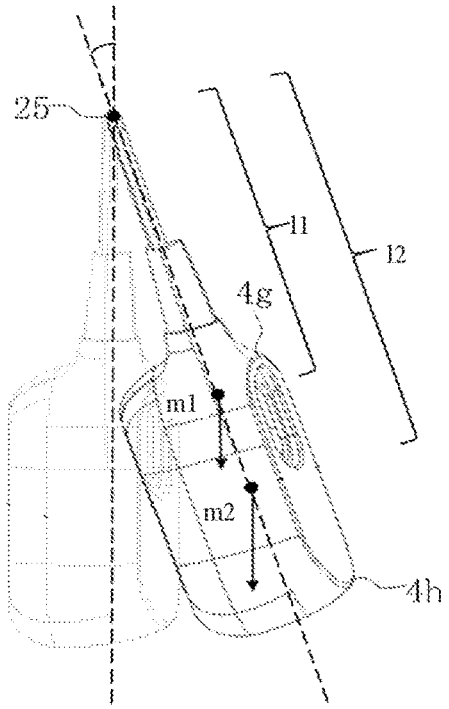
FIG. 2 is a schematic diagram illustrating a speaker assembly of an exemplary speaker device according to some embodiments of the present disclosure.

FIG. 1 is a schematic diagram illustrating an exemplary speaker device according to some embodiments of the present disclosure. FIG. 2 is a schematic diagram illustrating a speaker assembly of an exemplary speaker device according to some embodiments of the present disclosure. The speaker device 100 may transmit a sound to an auditory system of a user of the speaker device 100 via a bone conduction mode, an air conduction mode, or the like, or any combination thereof so that the user can hear the sound. In some embodiments, the speaker device 100 may include a supporting connector 10 and at least one speaker assembly 40 disposed on the supporting connector 10. In some embodiments, the supporting connector 10 may include an ear hook 50. Specifically, the supporting connector 10 may include two ear hooks 50 and a rear hook 30, and the rear hook 30 may be connected to the two ear hooks 50 and disposed between the two ear hooks 50. When the speaker device 100 is worn by the user, the two ear hooks 50 may correspond to the left ear and the right ear of the user, respectively, and the rear hook 30 may correspond to the back of the head of the user. The ear hook 50 may be configured to contact with the head of the user, and one or more contact points (e.g., one or more points located near a top point 25) of the ear hook 50 and the head of the user may include a vibration fulcrum of the speaker assembly 40 when the speaker assembly 40 vibrates.

In some embodiments, the vibration of the speaker assembly 40 may be regarded as a reciprocating swing movement. The top point 25 of the ear hook 50 may be regarded as a fixed point of the reciprocating swing movement, and a portion of the ear hook 50 between the top point 25 of the ear hook 50 and the speaker assembly 40 may be regarded as an arm of the reciprocating swing movement. The fixed point of the reciprocating swing movement may be regarded as the vibration fulcrum. In some embodiments, a swing amplitude (i.e., vibration acceleration) of the speaker assembly 40 may be a positive correlation with a volume generated by the speaker assembly 40. A mass distribution of the speaker assembly 40 may affect the amplitude of the swing amplitude of the speaker assembly 40, and further affect the volume generated by the speaker assembly 40.

In some embodiments, the speaker assembly 40 may include a headphone core, a housing 20 configured to accommodate the headphone core, a speaker module (not shown in the figure), and at least one button 4*d*. For example, the speaker module may include a first speaker module and a second speaker module, which are disposed within the speaker assembly 40. The first speaker module may be disposed on the speaker assembly 40 disposed at a first end of the speaker device 100. The second speaker module may be disposed on the speaker assembly 40 disposed at a second end of the speaker device 100. In some embodiments, the speaker module may refer to all components of the speaker assembly 40 other than the button 4*d*. For example, the speaker module may refer to the headphone core, the housing 20, and one or more units (e.g., a microphone, a flexible circuit board, a bonding pad, etc.) accommodated in the housing 20.

In some embodiments, the supporting connector 10 may be configured to accommodate a control circuit (not shown in the figure) or a battery (not shown in the figure). The control circuit or the battery may drive the headphone core to vibrate to generate a sound.

In some embodiments, the button 4*d* may be configured for user operation. For example, a user may operate the button 4*d* to perform a function such as a pause/start function, a recording function, an answering a call function, or the like, or any combination thereof.

In some embodiments, the button 4*d* may implement different interactive functions based on a user's operation instruction. For example, the user may click the button 4*d* once to pause/start e.g., music, recording, etc. As another example, the user may click the button 4*d* twice to answer a call. As a further example, the user may regularly click the button 4*d* (e.g., click the button 4*d* once every second, click the button 4*d* twice in total) to activate a recording function of the speaker device 100. In some embodiments, the user's operation instruction may include a click, a slid, a scroll, or the like, or any combination thereof. For example, the user may slide up and down on a surface of the button 4*d* to realize a function of switching songs.

In some application scenarios, the speaker assembly 40 may include at least two buttons 4*d*, and the at least two buttons 4*d* may correspond to a first ear hook (e.g., a left ear hook) of the two ear hooks 50 and the second ear hook (e.g., a right ear hook) of the two ear hooks 50, respectively. The user may use the left and right hands to operate the at least two buttons 4*d*, respectively, thereby improving the user's experience.

In some embodiments, to further improve the user's human-computer interaction experience, the human-computer interaction function may be allocated to the buttons 4*d* corresponding to the first ear hook and the second ear hook, respectively. The user may operate each of the at least two buttons 4*d* to realize corresponding functions. For example, the user may click the button 4*d* corresponding to the first ear hook once to activate a recording function, and/or click the button 4*d* corresponding to the first ear hook again to turn off the recording function. As another example, the user may click the button 4*d* corresponding to the first ear hook twice to realize the pause/play function. As another example, the user may click the button 4*d* corresponding to the second ear hook twice to answer a call or realize a next/previous song function when music is playing and there is no call.

In some embodiments, the aforementioned functions corresponding to the at least two buttons 4*d* may be determined by the user. For example, the user may assign the pause/play function executed by the button 4*d* corresponding to the first ear hook to the button 4*d* corresponding to the second ear hook by setting an application software.

As another example, the user may determine that the function of answering a call function executed by performing an operation on the button 4*d* corresponding to the first ear hook may be replaced by performing an operation on the button 4*d* corresponding to the second ear hook. In some embodiments, for a specific function, the user may determine the user's operation instruction (e.g., a number of clicking the button 4*d*, a sliding gesture, etc.) by setting the application software to perform the function. For example, a user's operation instruction corresponding to the answering a call function may be determined as click the button 4*d* twice instead of once. As another example, a user's operation instruction corresponding to the next/previous song function may be determined as click the button 4*d* three times instead of twice. The user may determine the user's operation instruction based on a habit of the user, thereby improving the user experience.

In some embodiments, the above-mentioned interaction function may be not unique, which may be determined according to functions commonly used by the user. For example, the button 4*d* may be used to perform a call rejection function, a text messages read function, or the like, or any combination thereof. The user may determine the interaction function and/or the user's operation instruction, thereby meeting different needs.

In some embodiments, a distance between a center of the button 4*d* and the vibration fulcrum may be not greater than a distance between a center of the speaker module and the vibration fulcrum, thereby improving the vibration acceleration of the speaker assembly 40 and the volume generated by the vibration of the speaker assembly 40.

In some embodiments, the center of the button 4*d* may include a center of mass m1 or a centroid g1. A first distance l1 may be formed between the center of mass m1 or the centroid g1 of the button 4*d* and the top point 25 (i.e., the vibration fulcrum) of the ear hook 50. A second distance l2 may be formed between a center of mass m2 or a centroid g2 of the speaker module and the top point 25 of the ear hook 50. It should be noted that the center of mass and the centroid (e.g., the center of mass m2 and the centroid g2) of the speaker module may be replaced by a center of mass and a centroid of the housing 20, respectively.

In some embodiments, a mass distribution of the button 4*d* and/or the speaker module may be relatively uniform. The center of mass m1 of the button 4*d* may coincide with the centroid g2 of the button 4*d*. The center of mass m2 of the speaker module may coincide with the centroid g2 of the speaker module.

In some embodiments, the vibration of the speaker assembly 40 may be indicated by a ratio of the first distance l1 to the second distance l2, and a ratio k of a mass of the button 4*d* to a mass of the speaker module.

Specifically, according to the dynamic principle, when the button 4*d* is arranged at a far end 4*h* of the top point 25 of the ear hook 50 away from the top point 25 of the ear hook 50, a vibration acceleration of the speaker assembly 40 may be less than a vibration acceleration of the speaker assembly 40 when the button 4*d* is arranged at a proximal end 4*g* of the top point 25 of the ear hook 50, thereby reducing the volume generated by the speaker assembly 40. When the mass of the button 4*d* is constant, the vibration acceleration of the speaker assembly 40 may be decreased as the ratio of the first distance l1 to the second distance l2 increases, thereby reducing the volume generated by the speaker assembly 40. When the ratio of the first distance 11 to the second distance 12 is constant, the vibration acceleration of the speaker assembly 40 may be decreased as the mass of the button 4*d* increases, thereby reducing the volume generated by the speaker assembly 40. The volume generated by the speaker assembly 40 may be determined and/or adjusted within a range that the ear of the user can recognize by adjusting the ratio of the first distance l1 to the second distance l2 and/or the mass ratio k of the button 4*d* to the mass of the speaker module.

In some embodiments, the ratio of the first distance l1 to the second distance l2 may not be greater than 1.

Specifically, when the ratio of the first distance l1 to the second distance l2 is equal to 1, the center of mass m1 and centroid g1 of the button 4*d* may coincide with the center of the mass m2 and the centroid g2 of the speaker module, respectively, and the button 4*d* may be disposed on a center of the speaker assembly 40. When the ratio of the first distance l1 to the second distance l2 is less than 1, the center of mass m1 or the centroid g1 of the button 4*d* may be closer to the top point 25 of the ear hook 50 with respect to the center of mass m2 or the centroid g2 of the speaker module, and the button 4*d* may be disposed on a proximal end close to the top point 25 of the ear hook 50. The less the ratio of the first distance l1 to the second distance l2 is, the closer the center of mass m1 or centroid g1 of the button 4*d* to the top point 25 of the ear hook 50 relative to the center of mass m2 or centroid g2 of the speaker module is.

In some embodiments, the ratio of the first distance l1 to the second distance l2 may be not greater than 0.95, and the button 4*d* may be closer to the top point 25 of the ear hook 50. In some embodiments, the ratio of the first distance l1 to the second distance l2 may be 0.9, 0.8, 0.7, 0.6, 0.5, etc., which may be determined according to actual needs and is not limited herein.

Further, when the ratio of the first distance l1 to the second distance l2 satisfies a range aforementioned, the ratio of the mass of the button 4*d* to the mass of the speaker module may not be greater than 0.3. For example, the ratio of the mass of the button 4*d* to the mass of the speaker module may not be greater than 0.29, 0.23, 0.17, 0.1, 0.06, 0.04, etc., which are not limited herein.

It should be noted that the center of mass m1 of the button 4*d* may coincide with the centroid g1 of the button 4*d* (not shown in the figure), that is, the center of mass m1 of the button 4*d* and the centroid g1 of the button 4*d* may locate at a same point. When the mass distribution of the button 4*d* and the speaker module is relatively uniform, the center of mass m2 of the speaker module may coincide with the centroid g2 (not shown in the figure) of the speaker module.

In some embodiments, the center of mass m1 may not coincide with the centroid g1 of the button 4*d*. A structure of the button 4*d* may be relatively simple and/or regular, the centroid g1 of the button 4*d* may be calculated relatively easily, the centroid g1 may be regarded as a reference point. The center of mass m2 may not coincide with the centroid g2 of the speaker module. One or more units (e.g., a microphone, a flexible circuit board, a bonding pad, etc.) of the speaker module may be made of different materials, the mass distribution of the speaker module may be not uniform, and the one or more units may have an irregular shape, the center of mass m2 of the speaker module may be regarded as a reference point.

In some application scenarios, the first distance l1 may be formed between the centroid g1 of the button 4*d* and the top point 25 of the ear hook 50, and the second distance l2 may be formed between the center of mass m2 of the speaker module and the top point 25 of the ear hook 50. The vibration of the button 4*d* in the speaker assembly 40 may be indicated by the ratio of the first distance l1 to the second distance l2, and the ratio k of a mass of the button 4*d* to the mass of the speaker module. Specifically, when the mass of the button 4*d* is constant, the vibration acceleration of the speaker assembly 40 may be decreased as the ratio of the first distance l1 to the second distance l2 increases, thereby reducing the volume generated by the speaker assembly 40. When the ratio of the first distance 11 to the second distance 12 is constant, the vibration acceleration of the speaker assembly 40 may be decreased as the mass of the button 4*d* increases, thereby reducing the volume generated by the speaker assembly 40. The volume generated by the speaker assembly 40 may be determined and/or adjusted within a range that the ear can recognize by adjusting the ratio of the first distance l1 to the second distance l2 and/or the mass ratio k of the button 4*d* to the mass of the speaker module.

In some embodiments, the ratio of the first distance l1 to the second distance l2 may not be greater than 1.

Specifically, when the ratio of the first distance l1 to the second distance l2 is equal to 1, the centroid g1 of the button 4*d* may coincide with the center of mass the m2, and the button 4*d* may be disposed on a center of the speaker assembly 40. When the ratio of the first distance l1 to the second distance l2 is less than 1, the centroid g1 of the button 4*d* may be closer to the top point 25 of the ear hook 50 with respect to the center of the mass m2 of the speaker module, and the button 4*d* may be disposed on the proximal end close to the top point 25 of the ear hook 50. The less the ratio of the first distance l1 to the second distance l2 is, the closer the center of mass m1 or centroid g1 of the button 4*d* to the top point 25 of the ear hook 50 relative to the center of mass m2 or centroid g2 of the speaker module.

In some embodiments, the ratio of the first distance 11 to the second distance 12 may be not greater than 0.95, and the button 4*d* may be closer to the top point 25 of the ear hook 50. In some embodiments, the ratio of the first distance 11 to the second distance 12 may be 0.9, 0.8, 0.7, 0.6, 0.5, etc., which may be determined according to actual needs and is not limited herein.

Further, when the ratio of the first distance l1 to the second distance l2 satisfies a range aforementioned, the ratio of the mass of the button 4*d* to the mass of the speaker module may not be greater than 0.3. For example, the ratio of the mass of the button 4*d* to the mass of the speaker module may not be greater than 0.29, 0.23, 0.17, 0.1, 0.06, 0.04, etc., which are not limited herein.

It should be noted that, in some embodiments, the centroid g2 of the speaker module be regarded as the reference point, which may be similar to the foregoing mentioned embodiments, which is not be repeated herein.

Figure 3:
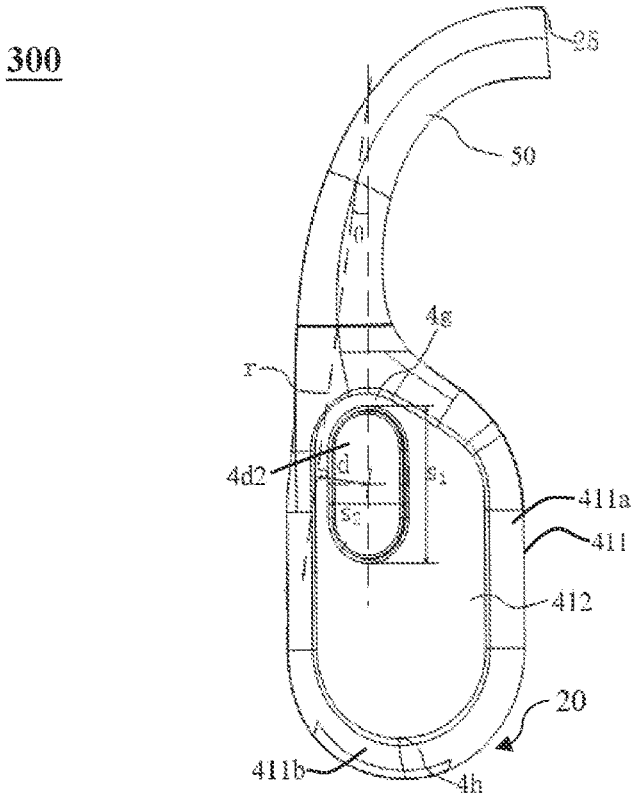
FIG. 3 is a schematic structural diagram illustrating a speaker assembly of a speaker device according to some embodiments of the present disclosure.

FIG. 3 is a schematic structural diagram illustrating a speaker assembly of a speaker device according to some embodiments of the present disclosure. In some embodiments, a speaker module of the speaker assembly 300 may include a headphone core and a housing 20. The headphone core may be configured to generate a sound and the housing 20 may be configured to accommodate the headphone core.

In some embodiments, the housing 20 may include an outer side wall 412 and a peripheral side wall 411. The peripheral side wall 411 may be connected to and surrounding the outer side wall 412. When a user wears the speaker device, the side opposite to the outer side wall 412 (which is behind the outer side wall 412 in FIG. 3 and not shown) may be in contact with the human head, and the outer side wall 412 may be located away from the human head. In some embodiments, the housing 20 may include a cavity configured to accommodates the headphone core.

In some embodiments, the peripheral side wall 411 may include a first peripheral side wall 411*a* arranged along a length direction of the outer side wall 412 and a second peripheral side wall 411*b* arranged along a width direction of the outer side wall 412. The outer side wall 412 and the peripheral side wall 411 may be connected and form the cavity with an open end, and the cavity may be configured to accommodate the headphone core.

In some embodiments, a count (or a number) of the first peripheral side wall 411*a* and/or the second peripheral side wall 411*b* may be two. The first peripheral side wall 411*a* and the second peripheral side wall 411*b* may be enclosed in sequence. When the user wears the speaker device, the two first peripheral side walls 411*a* may face a front side and a back side of the user's head, respectively. The two second peripheral side walls 411*b* may face an upper side and a lower side of the user's head, respectively.

In some embodiments, the outer side wall 412 may cover an end of the first peripheral side wall 411*a* and the second peripheral side wall 411*b* after the first peripheral side wall 411*a* and the second peripheral side wall 411*b* are enclosed. The housing 20 with an open end and a closed end may be formed and configured to accommodate the headphone core.

In some embodiments, a shape enclosed by the first peripheral side wall 411*a* and the second peripheral side wall 411*b* may be not limited. The shape enclosed by the first peripheral side wall 411*a* and the second peripheral side wall 411*b* may include any shape suitable for wearing on the user's head, such as a rectangle, a square, a circle, an ellipse, etc.

In some embodiments, the shape enclosed by the first peripheral side wall 411*a* and the second peripheral side wall 411*b* may conform to the principle of ergonomics, thereby improving the wearing experience of the user. In some embodiments, a height of the first peripheral side wall 411*a* and a height of the second peripheral side wall 411*b* may be the same or different. When heights of two successively connected peripheral side walls 411 are not the same, a protruding part of the peripheral side wall 411 may not affect the wearing and/or operation of the user.

Figure 4:
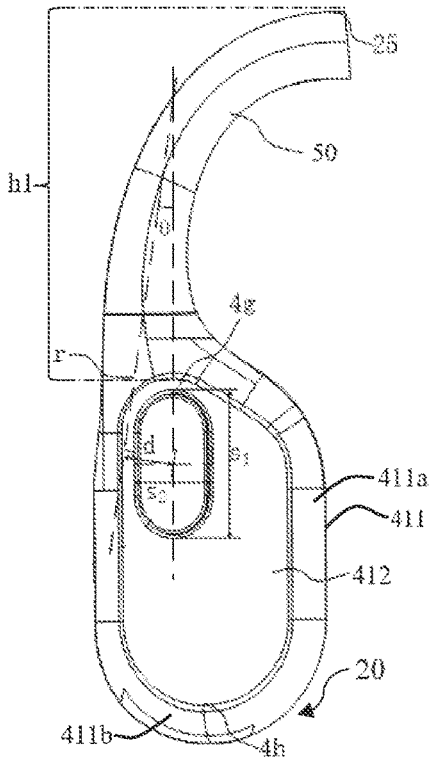
FIG. 4 is a schematic diagram illustrating a distance h1 according to some embodiments of the present disclosure.
Figure 5:
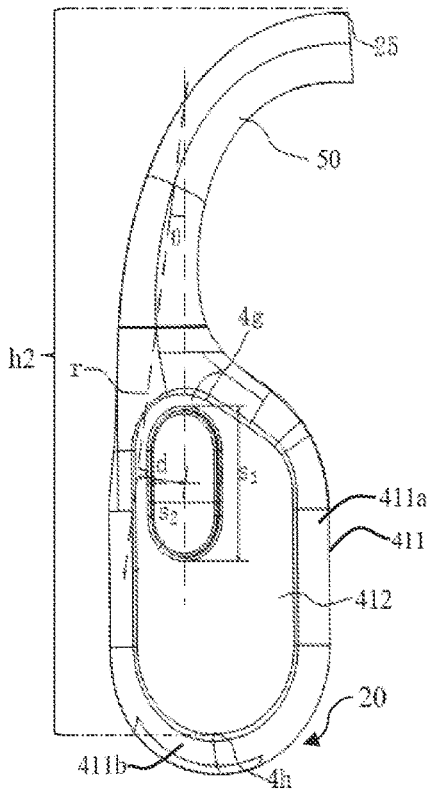
FIG. 5 is a schematic diagram illustrating a distance h2 according to some embodiments of the present disclosure.
Figure 6:
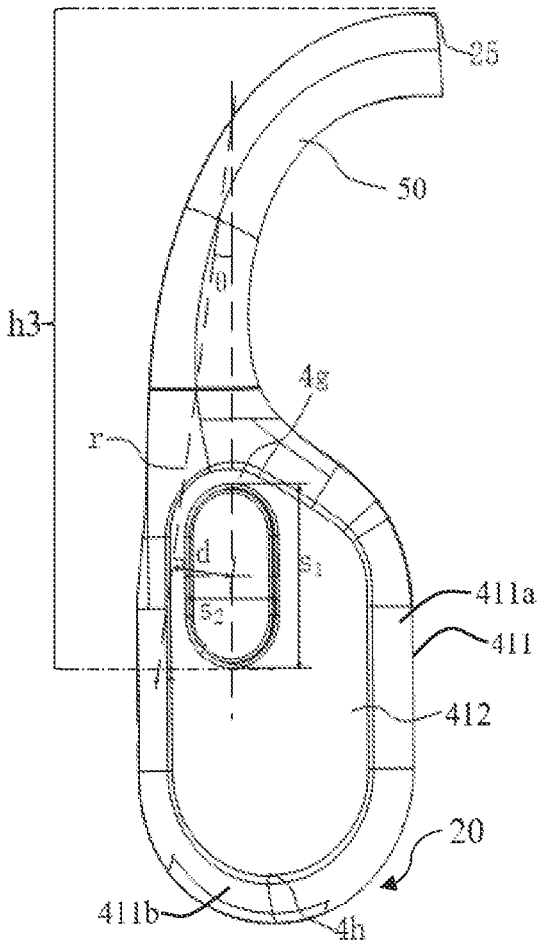
FIG. 6 is a schematic diagram illustrating a distance h3 according to some embodiments of the present disclosure.

FIG. 4 is a schematic diagram illustrating a distance h1 according to some embodiments of the present disclosure. FIG. 5 is a schematic diagram illustrating a distance h2 according to some embodiments of the present disclosure. FIG. 6 is a schematic diagram illustrating a distance h3 according to some embodiments of the present disclosure. In some embodiments, an outer side wall 412 may be disposed on an end enclosed by a first peripheral side wall 411*a* and a second peripheral side wall 411*b*. When a user wears a speaker device, the outer side wall 412 may be located at an end of the first peripheral side wall 411*a* and the second peripheral side wall 411*b* away from the user's head. In some embodiments, the outer side wall 412 may include a proximal end point and a distal end point. The proximal end point and the distal end point may be located on a contour connecting the outer side wall 412 with the first peripheral side wall 411*a* and the second peripheral side wall 411*b*, respectively. The proximal end point may be opposite to the distal end point on the contour. In some embodiments, the distance h1 between the proximal end point and a vibration fulcrum may be relatively short, and the proximal end may be referred to as at a top position. The distance h2 between the distal end point and the vibration fulcrum may be relatively long, and the distal end point may be referred to as at a bottom position. The distance h3 between a midpoint of a line connecting the proximal end point and the distal end point and the vibration fulcrum may be between h1 and h2, and the midpoint may be referred to as at a middle position.

In some embodiments, the button 4*d* may be located in the middle position of the outer side wall 412. In some embodiments, the button 4*d* may be located between the middle position and the top position of the outer side wall 412.

Figure 7:
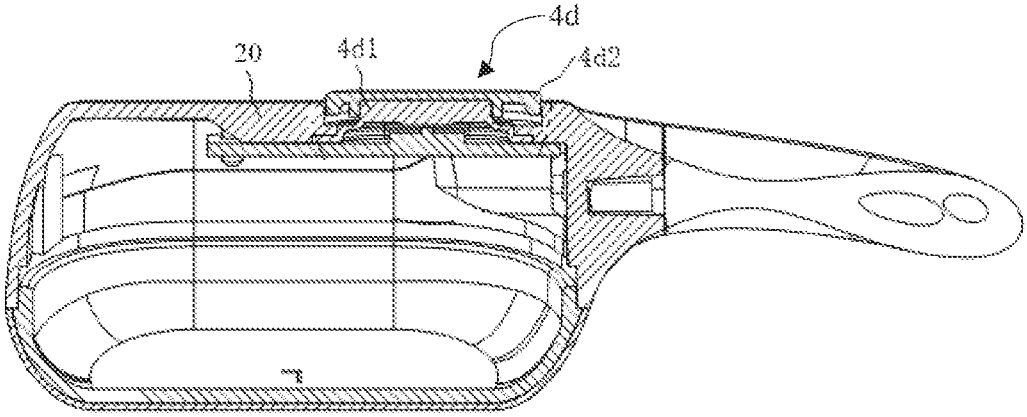
FIG. 7 is a schematic diagram illustrating a cross-sectional view of a partial structure of an exemplary speaker assembly according to some embodiments of the present disclosure.

FIG. 7 is a schematic diagram illustrating a cross-sectional view of a partial structure of an exemplary speaker assembly according to some embodiments of the present disclosure. As shown in FIG. 7, a button 4*d* may include an elastic bearing 4*d*1 and a button block 4*d*2.

In some embodiments, a shape of the button block 4*d*2 may be a rectangle with rounded corners, and the button block 4*d*2 may extend along a length direction of the outer side wall 412. The button block 4*d*2 may include two symmetry axes (e.g., a long axis and a short axis), and the button block 4*d*2 may be arranged symmetrically in two symmetry directions, and the symmetry directions are perpendicular to each other.

Figure 8:
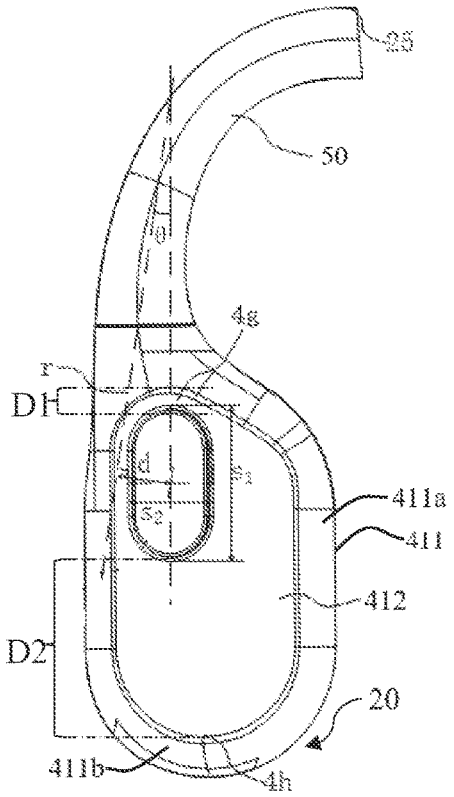
FIG. 8 is a schematic diagram illustrating a distance D1 and a distance D2 according to some embodiments the present disclosure.

FIG. 8 is a schematic diagram illustrating a distance D1 and a distance D2 according to some embodiments the present disclosure. As shown in FIG. 8, a vertical distance (along the long axis direction of the button 4g) between a top of the button 4g and a top end position of an outer side wall 412 is the first distance D1. A vertical distance between a bottom of the button 4g and a bottom end position of the outer side wall 412 is the second distance D2. A ratio of the first distance D1 to the second distance D2 may not be greater than 1.

Specifically, when the ratio of the distance D1 to the distance D2 is equal to 1, the button 4g may be located in a middle position of the outer side wall 412. When the ratio of the first distance D1 and the second distance D2 is less than 1, the button 4g may be located between the middle position and the top end position of the outer side wall 412.

In some embodiments, the ratio of the first distance D1 to the second distance D2 may be not greater than 0.95, and the button 4g may be located closer to the top end position of the outer wall 412 than the bottom end position, thereby improving a volume of a speaker assembly 40. In some embodiments, the ratio of the first distance D1 to the second distance D2 may be 0.9, 0.8, 0.7, 0.6, 0.5, etc., which may be determined according to different needs and is not limited herein.

In some embodiments, a connection portion connecting the ear hook 50 and the speaker module may have a central axis. In some embodiments, an extension line r of the central axis may have a projection on a plane where the outer surface of the button 4g locates. An angle θ formed between the projection and the long axis direction of the button 4g may be less than 10°, for example, 9°, 7°, 5°, 3°, 1°, etc., which is not limited herein.

When the angle θ formed between the projection of the extension line r on the plane where the outer surface of the button 4g locates and the long axis direction is less than 10°, a deviation of the long axis direction of the button 4g from the extension line r may be relatively small, and the long axis direction of the button 4g may be regarded as consistent or substantially consistent with the direction of the extension line r of the central axis.

In some embodiments, the long axis direction of the outer surface of the button 4g and the short axis direction of the outer surface of the button 4g may have an intersection. A distance d between the projection and the intersection may be relatively small. The distance d may be less than a width $S_2$ of the outer surface along the short axis direction of the button 4g, making the button 4g close to the extension line r of the central axis of the ear hook 50. In some embodiments, the projection of the extension line r of the central axis of the earhook 50 on the plane where the outer surface of the button 4g locates may coincide with the long axis direction of the button 4g, thereby further improving the sound quality of the speaker assembly 40.

In some embodiments, a long axis of the button 4g may be in a direction from the top of the button 4g to the bottom of the button 4g, or a direction in which the ear hook 50 may be connected to the housing 20. The short axis of the button 4g may be perpendicular to the long axis of the button 4g and pass through a midpoint of a line connecting the top of the button 4g and the bottom of the button 4g. A size of the button 4g along the long axis direction may be $S_1$, and a size of the button 4g along a circumferential direction may be $S_2$.

In some embodiments, the first peripheral side wall 411a may have a bottom end position, a middle position, and a top end position.

The bottom end position of the first peripheral side wall 411a may include a connection point connecting the first peripheral side wall 411a and the second peripheral side wall 411b which is away from the ear hook 50. The top end position may include a connection point connecting the first peripheral side wall 411a and the second peripheral side wall 411b which is close to the ear hook 50. The middle position may include a midpoint of a line connecting the bottom end position and the top end position of the first peripheral side wall 411a.

In some embodiments, the button 4g may be disposed on the middle position of the first peripheral side wall 411a (not shown in the figure), or between the middle position and the top end position of the first peripheral side wall 411b (not shown in the figure). The button 4g may be centrally disposed on the first peripheral side wall 411a along a width direction of the first peripheral side wall 411a (the width direction of the first peripheral side wall is perpendicular to the plane where the outer surface of the button 4g locates).

Figure 9:
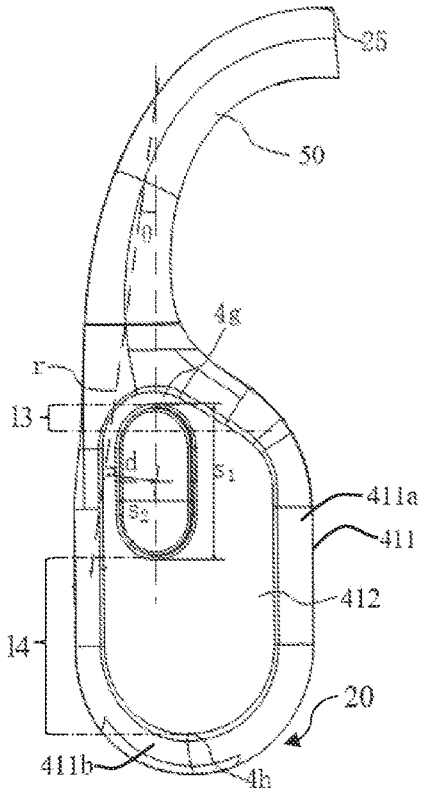
FIG. 9 is a schematic diagram illustrating a distances l3 and a distance l4 according to some embodiments of the present disclosure.

FIG. 9 is a schematic diagram illustrating a distance l3 and a distance l4 according to some embodiments of the present disclosure. As shown in FIG. 9, the distance l3 refers to a vertical distance (along the long axis direction of the button 4g) between a top of a button 4g and a top end position of a first peripheral side wall 411a. The distance l4 refers to a vertical distance between a bottom of the button 4g and a bottom end position of the first peripheral side wall 411. A ratio of the distance l3 to the distance l4 may be not greater than one.

Further, the ratio of the distance l3 to the distance l4 may be not greater than 0.95, so that the button 4g may be relatively close to the top end position of the first peripheral side wall 411a, that is, the button 4g may be relatively close to the vibration fulcrum, thereby improving the volume generated by a speaker assembly (e.g., the speaker assembly 40). The ratio of the distance l3 to the distance l4 may also be 0.9, 0.8, 0.7, 0.6, 0.5, etc., which may be determined according to the actual need and not limited herein.

It should be noted that the above descriptions are only some specific examples and should not be regarded as the only feasible implementations. Obviously, for those skilled in the art, after understanding the basic principle of the speaker device, it is possible to make various modifications in forms and details to the specific methods and steps of implementing the speaker device without departing from this principle of the present disclosure. For example, the button 4g may be disposed in one of the speaker assemblies on the left side and right side of the speaker device. As another example, the button 4g may be disposed in both speaker assemblies on the left side and right side of the speaker device. However, those variations, changes, and modifications do not depart from the scope of the present disclosure.

In some embodiments, the speaker device may further include a speaker mechanism such as a bone conduction speaker mechanism, an air conduction speaker mechanism, or the like, or any combination thereof. The speaker mechanism may adopt a sound conduction mode that converts a sound into mechanical vibrations with different frequencies, and transmit sound waves through the human skull, the bone labyrinth, the inner ear lymphatic fluid, the spiral organs, the auditory nerve, the auditory center, etc. In some embodiments, the speaker mechanism may include an MP3 player, a hearing aid, etc.

In some embodiments, the speaker mechanism of the speaker device may be an independent player that may be used directly. In some embodiments, the speaker mechanism of the speaker device may be a player that is disposed on an electronic device.

It should be known that, without departing from the principle, the descriptions described below can be applied to an air conduction speaker device, a bone conduction speaker device, etc.

Figure 10:
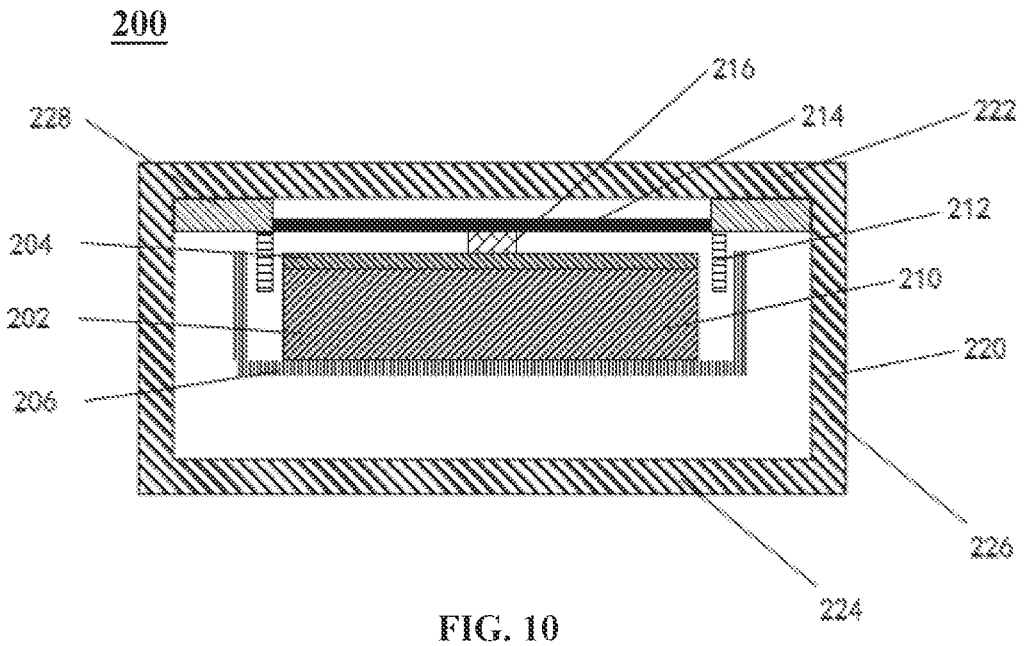
FIG. 10 is a schematic diagram illustrating a longitudinal cross-sectional view of a speaker device according to some embodiments of the present disclosure.

FIG. 10 is a schematic diagram illustrating a longitudinal cross-sectional view of a speaker device according to some embodiments of the present disclosure. As shown in FIG. 10, in some embodiments, the speaker device may include a magnetic circuit assembly 210, a coil 212, a vibration transmission plate 214, a connector 216, and a housing 220. In some embodiments, the magnetic circuit assembly 210 may include a first magnetic element 202, a first magnetically conductive element 204, and a second magnetically conductive element 206. In some embodiments, the housing 220 may have a same or similar structure as the housing 20 described according to some embodiments of the present disclosure.

In some embodiments, the housing 220 may include a first housing panel 222, a second housing panel 224, and a housing side 226. The first housing panel 222 and the second housing panel 224 may be disposed on two end sides of the housing side 226, respectively. The second housing panel 224 may be disposed opposite to the housing panel 222. The first housing panel 222, the housing panel 224, and the housing side 226 may form an integral structure with a certain accommodation space. In some embodiments, the magnetic circuit assembly 210, the coil 212, and the vibration transmission plate 214 may be fixedly disposed within the housing 220. In some embodiments, the speaker device may further include a housing bracket 228. The vibration transmission sheet 214 may be connected to the housing 220 via the housing bracket 228. In some embodiments, the coil 212 may be fixedly disposed on the housing bracket 228. The coil 212 may drive the housing 220 to vibrate through the housing bracket 228. The housing bracket 228 may be a part of the housing 220 or a component independent from the housing 220. The housing bracket 228 may be directly or indirectly connected to an inner of the housing 220. In some embodiments, the housing bracket 228 may be fixedly disposed on an inner surface of the housing side 226. In some embodiments, the housing bracket 228 may be pasted on the housing 220 by glue. In some embodiments, the housing bracket 228 may be fixed on the housing 220 via a stamping connection, an injection molding connection, a clamping connection, a riveting connection, a threading connection, a welding connection, or the like, or any combination thereof.

In some embodiments, a connection mode between each two of the first housing panel 222, the second housing panel 224, and the housing side 226 may be determined, thereby improving the rigidity of the housing 220. In some embodiments, the first housing panel 222, the second housing panel 224, and the housing side 226 may be integrally formed. For example, the second housing panel 224 and the housing side 226 may be integrally formed. As another example, the first housing panel 222 and the housing side 226 may be directly connected via a glue, or the first housing panel 222 and the housing side 226 may be connected with each other via a clamping connection, a welding connection, or a threading connection, or the like, or any combination thereof. In some embodiments, the first housing panel 222, the second housing panel 224, and the housing side 226 may be independent of each other. The first housing panel 222, the second housing panel 224, and the housing side 226 may be connected with each other via a bonding connection, a clamping connection, a welding connection, or a threading connection, or the like, or any combination thereof. For example, the first housing panel 222 and the housing side 226 may be connected via a bonding connection, and the second housing panel 224 and the housing side 226 may be connected via a clamping connection, a welding connection, or a threading connection. As another example, the second housing panel 224 and the housing side 226 may be connected via a bonding connection, and the first housing panel 222 and the housing side 226 may be connected via a clamping connection, a welding connection, or a threading connection.

Figure 12:
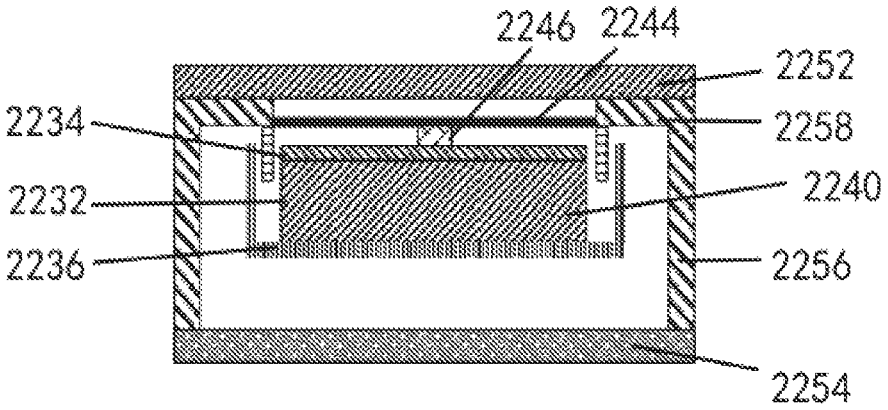
FIG. 12 is a schematic diagram illustrating a longitudinal cross-sectional view of a speaker device according to some embodiments of the present disclosure.
Figure 13:
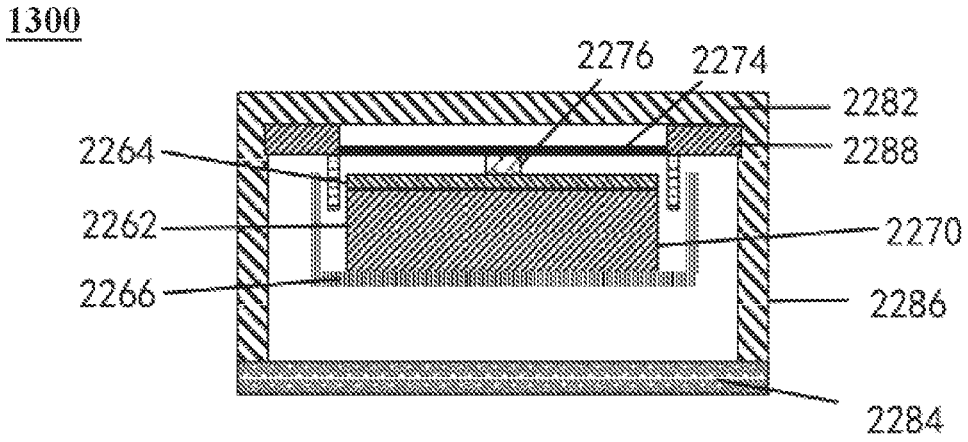
FIG. 13 is a schematic diagram illustrating a longitudinal cross-sectional view of a speaker device according to some embodiments of the present disclosure.

In different application scenarios, the housing of the speaker device described in the present disclosure may be assembled by different assembly modes. For example, as above described, the housing (e.g., housing 220) of a speaker device may be integrally formed, the speaker device may be combined by one or more independent components, or the like, or any combination thereof. The one or more components may be combined to generate the speaker device via a bonding connection, a clamping connection, a welding connection, a threaded connection. To illustrate the assembly mode of the housing of the speaker device, FIGS. 11-13 illustrates several examples of assembly modes of housings of exemplary speaker devices.

Figure 11:
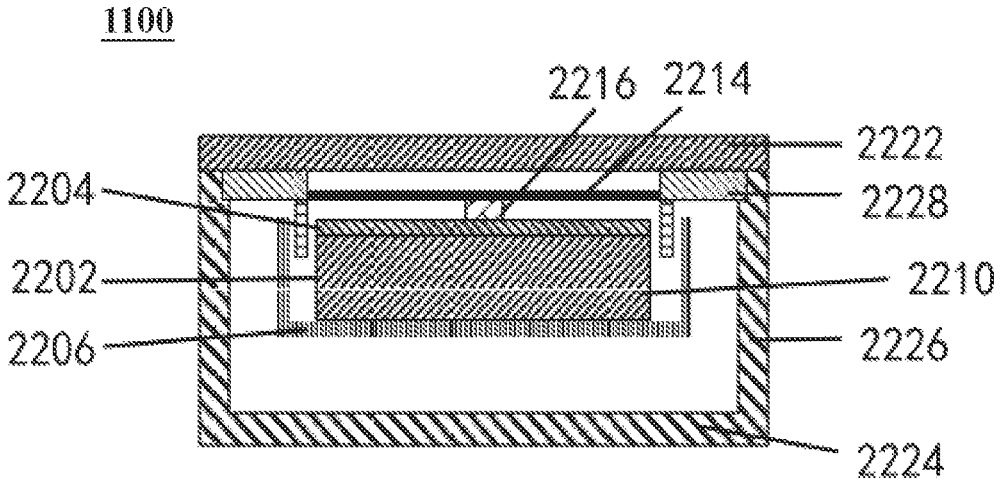
FIG. 11 is a schematic diagram illustrating a longitudinal cross-sectional view of a speaker device according to some embodiments of the present disclosure.

FIG. 11 is a schematic diagram illustrating a longitudinal cross-sectional view of a speaker device according to some embodiments of the present disclosure. As shown in FIG. 11, the speaker device 1100 may include a magnetic circuit assembly 2210 and a housing (e.g., the housing 220 described in FIG. 10). The magnetic circuit assembly 2210 may include a first magnetic element 2202, a first magnetically conductive element 2204, and a second magnetically conductive element 2206.

In some embodiments, the magnetic circuit components described in the above embodiments may have the same (or substantially the same) structure, which refers to a structure configured to provide a magnetic field. In some embodiments, the housings described in the above embodiments may be of the same structure, and each of the housing may be configured to accommodate the magnetic circuit assembly.

In some embodiments, the housing of the speaker device 1100 may include a housing panel 2222, a housing back 2224, and a housing side 2226. The housing side 2226 and the housing back 2224 may be integrally formed, and the housing panel 2222 may be connected to one end of the housing side 2226 as an independent component. For example, the housing panel 2222 may be connected to the end of the housing side 2226 via a bonding connection, a clamping connection, a welding connection, or a threading connection, or the like, or any combination thereof. The housing panel 2222 and the housing side 2226 (or the housing back 2224) may be made of different, the same, or partly the same materials. In some embodiments, the housing panel 2222 and the housing side 2226 may be made of the same material, and Young's modulus of the material may be greater than 2000 MPa. Preferably, Young's modulus of the material may be greater than 4000 MPa. More preferably, Young's modulus of the material may be greater than 6000 MPa. More preferably, Young's modulus of the material may be greater than 8000 MPa. More preferably, Young's modulus of the material may be greater than 12000 MPa. More preferably, Young's modulus of the material may be greater than 15000 MPa. More preferably, Young's modulus of the material may be greater than 18000 MPa. In some embodiments, the housing panel 2222 and the housing side 2226 may be made of different materials, and Young's modulus of the material of the housing panel 2222 and Young's modulus of the material of the housing side 2226 may be greater than 4000 MPa. Preferably, Young's modulus of the material of the housing panel 2222 and Young's modulus of the material of the housing side 2226 may be greater than 6000 MPa. More preferably, Young's modulus of the material of the housing panel 2222 and Young's modulus of the material of the housing side 2226 may be greater than 8000 MPa. More preferably, Young's modulus of the material of the housing panel 2222 and Young's modulus of the material of the housing side 2226 may be greater than 12000 MPa. More preferably, Young's modulus of the material of the housing panel 2222 and Young's modulus of the material of the housing side 2226 may be greater than 15000 MPa. More preferably, Young's modulus of the material of the housing panel 2222 and Young's modulus of the material of the housing side 2226 may be greater than 18000 MPa. In some embodiments, the material of the housing panel 2222 and/or the housing side 2226 may include but is not limited to acrylonitrile butadiene styrene (ABS), polystyrene (PS), high impact polystyrene (HIPS), polypropylene (PP), polyethylene terephthalate (PET), polyester (PES), polycarbonate (PC), polyamides (PA), polyvinyl chloride (PVC), polyurethanes (PU), polyethylene (PE), polymethyl methacrylate (PMMA), polyetheretherketone (PEEK), phenolics (PF), urea-formaldehyde (UF), melamine formaldehyde (MF), a metal, an alloy (e.g., aluminum alloy, chromium-molybdenum steel, scandium alloy, magnesium alloy, titanium alloy, magnesium-lithium alloy, nickel alloy, etc.), glass fiber, carbon fiber, or the like, or any combination thereof. In some embodiments, the material of the housing panel 2222 may include glass fiber, carbon fiber, PC, PA, or the like, or any combination thereof. In some embodiments, the material of the housing panel 2222 and/or the shell side 2226 may include a mixture generated by mixing carbon fiber and PC with a certain ratio. In some embodiments, the material of the housing panel 2222 and/or the housing side 2226 may include a mixture generated by mixing carbon fiber, glass fiber, and PC with a certain ratio. In some embodiments, the material of the shell panel 2222 and/or the shell side 2226 may include a mixture generated by mixing glass fiber and PC with a certain ratio, or a mixture generated by mixing glass fiber and PA with a certain ratio.

As shown in FIG. 11, the housing panel 2222, the housing back 2224, and the housing side 2226 may form an integral structure with an accommodation space. In some embodiments, within the integral structure, a vibration transmission plate 2214 may be connected to the magnetic circuit assembly 2210 via a connector 2216. Two sides of the magnetic circuit assembly 2210 may be connected to a first magnetically conductive element 2204 and a second magnetically conductive element 2206, respectively. The vibration transmission sheet 2214 may be fixedly disposed within the integral structure via a housing bracket 2228. In some embodiments, the housing side 2226 of the housing may have a step structure configured to support the housing bracket 2228. After the housing support 2228 is fixedly disposed on the housing side 2226, the housing panel 2222 may be fixedly disposed on the housing support 2228 and the housing side 2226, or the housing panel 2222 may be separately fixed on the housing support 2228 or the housing side 2226. Alternatively, the housing side 2226 and the housing bracket 2228 may be integrally formed. In some embodiments, the housing bracket 2228 may be fixedly disposed on the housing panel 2222 (e.g., via a bonding connection, a clamping connection, a welding connection, a threading connection, etc.). The fixed housing panel 2222 and housing bracket 2228 may be fixed to the housing side 2226 e.g., via a bonding connection, a clamping connection, a welding connection, a threading connection, etc. Alternatively, the housing bracket 2228 and the housing panel 2222 may be integrally formed.

FIG. 12 is a schematic diagram illustrating a longitudinal cross-sectional view of a speaker device according to some embodiments of the present disclosure. As shown in FIG. 12, the speaker device 1200 may include a magnetic circuit assembly 2240 and a housing. The magnetic circuit assembly 2240 may include a first magnetic element 2232, a first magnetically conductive element 2234, and a second magnetically conductive element 2236. A vibration transmission plate 2244 may be connected to the magnetic circuit assembly 2240 via a connector 2246.

In some embodiments, the magnetic circuit assemblies (e.g., the magnetic circuit assembly 210, the magnetic circuit assembly 2210, the magnetic circuit assembly 2240, etc.) described in the above embodiments may be of the same structure, and each of the magnetic circuit assemblies may be configured provide a magnetic field. In some embodiments, the housings described in the above embodiments may be of the same structure, and each of the housings may be configured to accommodate the magnetic circuit assembly. In some embodiments, the vibration transmission plates (e.g., the vibration transmission plate 214, the vibration transmission plate 2214, the vibration transmission plate 2244, etc.) described in the above embodiments may be of the same (or substantially the same) structure, and each of the vibration transmission plates may be configured to adjust a low-frequency resonance peak.

In some embodiments, the connectors described in the above embodiments may have the same (or substantially the same) structure, which refers to a structure configured to connect the vibration transmission plate and the magnetic circuit assembly. A housing bracket 2258 and a housing side 2256 of the speaker device described in FIG. 12 may be integrally formed, which may be different from the speaker device described in connection with FIG. 11. A housing panel 2252 may be fixedly disposed on a first side of a housing side 2256, and the first side of the housing side 2256 may be connected to the housing bracket 2258 (e.g., via a bonding connection, a snaping connection, a welding connection, a threaded connection, etc.) A housing panel 2254 may be disposed on a second side of the housing side 2256 (e.g., via a bonding connection, a snaping connection, a welding connection, a threaded connection, etc.). In this case, alternatively, the housing support 2258 and the housing side 2256 may be independent of each other. The housing panel 2252 and the housing bracket 2258, the housing bracket 2258 and the housing side 2256, and the housing side 2256 and the housing panel 2254 may be connected via a bonding connection, a snaping connection, a welding connection, a threaded connection, etc., respectively.

FIG. 13 is a schematic diagram illustrating a longitudinal cross-sectional view of a speaker device according to some embodiments of the present disclosure. As shown in FIG. 13, the speaker device 1300 may include a magnetic circuit assembly 2270 and a housing. The magnetic circuit assembly 2270 may include a first magnetic element 2262, a first magnetically conductive element 2264, and a second magnetically conductive element 2266. A vibration transmission plate 2274 may be connected to the magnetic circuit assembly 2270 through a connector 2276.

In some embodiments, the magnetic circuit assemblies (e.g., the magnetic circuit assembly 210, the magnetic circuit assembly 2210, the magnetic circuit assembly 2240, the magnetic circuit assembly 2270, etc.) mentioned in the above embodiments may be of the same structure, and each of the magnetic circuit assemblies may be configured provide a magnetic field. In some embodiments, the housings described in the above embodiments may be of the same structure, and each of the housings may be configured to accommodate the magnetic circuit assembly. In some embodiments, the vibration transmission plates (e.g., the vibration transmission plate 214, the vibration transmission plate 2214, the vibration transmission plate 2244, the vibration transmission plate 2274, etc.) described in the above embodiments may be of the same (or substantially the same) structure, and each of the vibration transmission plates may be configured to adjust a low-frequency resonance peak.

A difference between the speaker device 1300 and at least one of the speaker device 1100 and the speaker device 1200 may be that a housing panel 2282 and a housing side 2286 may be integrally formed. A housing panel 2284 may be fixed on the side surface 2286 of the housing (e.g., via a bonding connection, a snaping connection, a welding connection, a threaded connection, etc.), and the housing panel 2284 may be opposite to the housing panel 2282. A housing bracket 2288 may be fixed on the housing panel 2282 and/or the housing side 2286 via a bonding connection, a snaping connection, a welding connection, a threaded connection, etc. Alternatively, the housing bracket 2288, the housing panel 2282, and the housing side 2286 may be integrally formed.

Figure 14:
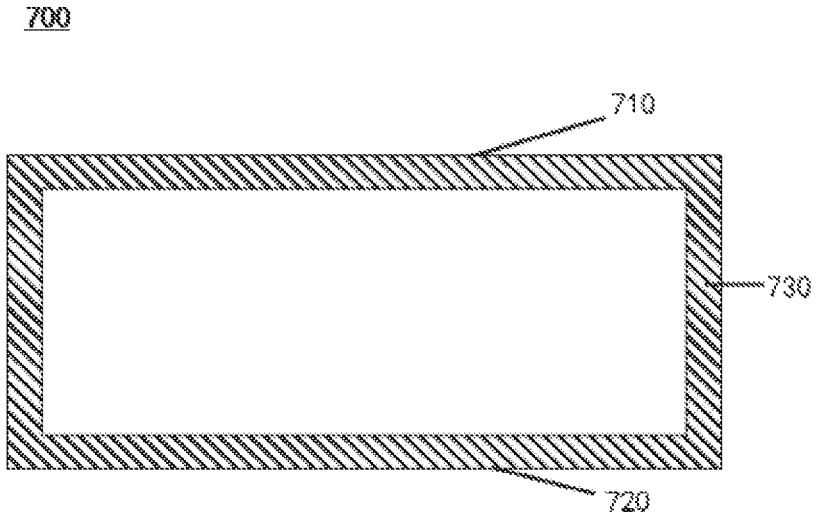
FIG. 14 is a schematic diagram illustrating a housing of an exemplary speaker device according to some embodiments of the present disclosure.

FIG. 14 is a schematic diagram illustrating a housing of an exemplary speaker device according to some embodiments of the present disclosure. As shown in FIG. 14, the housing body 700 may include a housing panel 710 facing a human body, a housing back 720, and a housing side 730 opposite to the housing panel 710. The housing panel 710 may be in contact with the human body, and transmit a vibration of the speaker device to the auditory nerve of the human body.

In some embodiments, a headphone core of a speaker device may cause the housing panel 710 and the housing back 720 to vibrate, the vibration of the housing panel 710 may have a first phase, and the vibration of the housing back 720 may have a second phase. An absolute value of a difference between the first phase and the second phase may be less than 60 degrees when a frequency of each of the vibration of the housing panel 710 and the vibration of the housing back 720 is between 2000 Hz and 3000 Hz.

In some embodiments, when the rigidity of the housing body 700 is relatively large, a vibration amplitude of the housing panel 710 and a vibration amplitude of the housing back 720 may be the same or substantially the same (e.g., the housing side 730 may not compress air and may not generate sound leakage), and the first phase of the substantially the same housing panel 710 and the second phase of the housing back 720 may be the same or within a frequency range. A first sound leakage sound wave generated by the housing panel 710 and a second sound leakage sound wave generated by the back surface 720 may be superimposed, thereby reducing an amplitude of the first leakage sound wave or an amplitude of the second leakage sound wave, and accordingly reducing the sound leakage of the housing body 700. In some embodiments, a portion of the frequency range may be greater than 500 Hz. Preferably, a portion of the frequency range may be greater than 600 Hz. More preferably, a portion of the frequency range may be greater than 800 Hz. More preferably, a portion of the frequency range may be greater than 1000 Hz. More preferably, a portion of the frequency range may be greater than 2000 Hz. More preferably, a portion of the frequency range may be greater than 5000 Hz. More preferably, a portion of the frequency range may be greater than 8000 Hz. More preferably, a portion of the frequency range may be greater than 10000 Hz.

In some embodiments, a rigidity of a housing body of a bone conduction speaker may affect a vibration amplitude and a phase of different components (e.g., the housing panel 710, the housing back 720, a housing side 730, etc.) of the housing body 700, thereby affecting the sound leakage of a bone conduction speaker device. In some embodiments, when the housing body 700 of the bone conduction speaker device has a relatively large rigidity, the housing panel 710 and the housing back 720 of the bone conduction speaker may have the same or substantially the same vibration amplitude and phase at a relatively high frequency, thereby significantly reducing the leakage of the sound of the bone conduction speaker device.

In some embodiments, the relatively high frequency may include a frequency not less than 1000 Hz, for example, a frequency between 1000 Hz and 2000 Hz, a frequency between 1100 Hz and 2000 Hz, a frequency between 1300 Hz and 2000 Hz, and a frequency between 1500 Hz and 2000 Hz, a frequency between 1700 Hz-2000 Hz, a frequency between 1900 Hz-2000 Hz, etc. Preferably, the relatively high frequency may include a frequency not less than 2000 Hz, for example, a frequency between 2000 Hz and 3000 Hz, a frequency between 2100 Hz and 3000 Hz, a frequency between 2300 Hz and 3000 Hz, a frequency between 2500 Hz and 3000 Hz, a frequency between 2700 Hz-3000 Hz, a frequency between 2900 Hz-3000 Hz, etc. More preferably, the relatively high frequency may include a frequency not less than 4000 Hz, for example, a frequency between 4000 Hz and 5000 Hz, a frequency between 4100 Hz and 5000 Hz, a frequency between 4300 Hz and 5000 Hz, a frequency between 4500 Hz and 5000 Hz, a frequency between 4700 Hz and 5000 Hz, a frequency between 4900 Hz-5000 Hz, etc. More preferably, the relatively high frequency may include a frequency not less than 6000 Hz, for example, a frequency between 6000 Hz and 8000 Hz, a frequency between 6100 Hz and 8000 Hz, a frequency between 6300 Hz and 8000 Hz, a frequency between 6500 Hz and 8000 Hz, a frequency between 7000 Hz and 8000 Hz, frequency between 7500 Hz and 8000 Hz, a frequency between 7900 Hz and 8000 Hz, etc. More preferably, the relatively high frequency may include a frequency not less than 8000 Hz, for example, a frequency between 8000 Hz and 12000 Hz, a frequency between 8100 Hz and 12000 Hz, a frequency between 8300 Hz and 12000 Hz, a frequency between 8500 Hz and 12000 Hz, a frequency between 9000 Hz and 12000 Hz, a frequency between 10000 Hz and 12000 Hz, a frequency between 11000 Hz and 12000 Hz, etc.

A same or substantially the same vibration amplitude between the housing panel 710 and the housing back 720 refers to that a ratio of the vibration amplitude of the housing panel 710 to the vibration amplitude of the housing back 720 is within a certain range. For example, the ratio of the vibration amplitude of the housing panel 710 to the vibration amplitude of the housing back 720 may be between 0.3 and 3. Preferably, the ratio of the vibration amplitude of the housing panel 710 to the vibration amplitude of the housing back 720 may be between 0.4 and 2.5. More preferably, the ratio of the vibration amplitude of the housing panel 710 to the vibration amplitude of the housing back 720 may be between 0.4 and 2.5. More preferably, the ratio of the vibration amplitude of the housing panel 710 to the vibration amplitude of the housing back 720 may be between 0.5 and 1.5. More preferably, the ratio of the vibration amplitude of the housing panel 710 to the vibration amplitude of the housing back 720 may be between 0.6 and 1.4. More preferably, the ratio of the vibration amplitude of the housing panel 710 to the vibration amplitude of the housing back 720 may be between 0.7 and 1.2. More preferably, the ratio of the vibration amplitude of the housing panel 710 to the vibration amplitude of the housing back 720 may be between 0.75 and 1.15. More preferably, the ratio of the vibration amplitude of the housing panel 710 to the vibration amplitude of the housing back 720 may be between 0.8 and 1.1. More preferably, the ratio of the vibration amplitude of the housing panel 710 to the vibration amplitude of the housing back 720 may be between 0.8 and 1.1. More preferably, the ratio of the vibration amplitude of the housing panel 710 to the vibration amplitude of the housing back 720 may be 0.85 and 1.1. More preferably, the ratio of the vibration amplitude of the housing panel 710 to the vibration amplitude of the housing back 720 may be between 0.9 and 1.05. In some embodiments, the vibration of the housing panel 710 and the housing back 720 may be represented by other physical quantities that can characterize the vibration amplitude. For example, a sound pressure generated by the housing panel 710 and a sound pressure generated by the housing back 720 at a point in the space may be configured to represent the vibration amplitude of the housing panel 710 and the housing back 720, respectively.

A same or substantially the same phase of the housing panel 710 and the housing back 720 refers to that a difference between the first phase and the second phase may be within a phase range. Preferably, the difference between the first vibration phase and the second phase may be between −90° and 90°. More preferably, the difference between the first vibration phase and the second phase may be between −80° and 80°. More preferably, the difference between the first vibration phase and the second phase may be between −60° and 60°. More preferably, the difference between the first vibration phase and the second phase may be between −45° and 45°. More preferably, the difference between the first vibration phase and the second phase may be between −30° and 30°. More preferably, the difference between the first vibration phase and the second phase may be between −20° and 20°. More preferably, the difference between the first vibration phase and the second phase may be between −15° and 15°. More preferably, the difference between the first vibration phase and the second phase may be between −12° and 12°. More preferably, the difference between the first vibration phase and the second phase may be between −10° and 10°. More preferably, the difference between the first vibration phase and the second phase may be between −8° and 8°. More preferably, the difference between the first vibration phase and the second phase may be between −6° and 6°. More preferably, the difference between the first vibration phase and the second phase may be between −5° and 5°. More preferably, the difference between the first vibration phase and the second phase may be between −4° and 4°. More preferably, the difference between the first vibration phase and the second phase may be between −3° and 3°. More preferably, the difference between the first vibration phase and the second phase may be between −2° and 2°. More preferably, the difference between the first vibration phase and the second phase may be between −1° and 1°. More preferably, the difference between the first vibration phase and the second phase may be 0°.

It should be noted that the above descriptions are only some specific examples and should not be regarded as the only feasible implementations. Obviously, for those skilled in the art, after understanding the basic principle of the speaker device, it is possible to make various modifications in forms and details to the housing body the speaker device without departing from this principle of the present disclosure. For example, the connection between the housing panel 710 and the housing side 730, the connection between the housing back 720 and the housing side 730 may be not limited to the above-mentioned connections. Merely by way of example, the housing side 730, the housing back 720, and a housing bracket may be integrally formed. As another example, the housing side 730, the housing back 720, the housing bracket, and the housing panel 710 may be integrally formed. However, those variations, changes, and modifications do not depart from the scope of the present disclosure.

Figure 15:
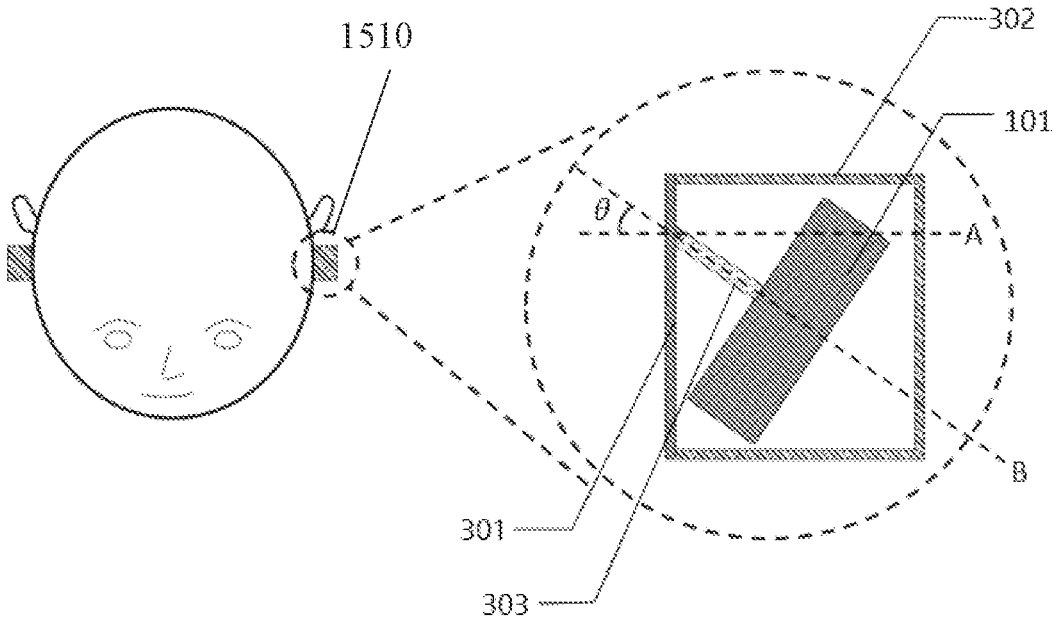
FIG. 15 is a schematic diagram illustrating an application scenario and a structure of an exemplary speaker device according to some embodiments of the present disclosure.

FIG. 15 is a schematic diagram illustrating an application scenario and a structure of an exemplary speaker device according to some embodiments of the present disclosure. As shown in FIG. 15, in some embodiments, the speaker device 1510 may include a driving device 101, a transmission assembly 303, a panel 301, and a housing 302.

It should be noted that the housing bodies, the housings mentioned in the above embodiments may be of the same structure, and each of the housing body and the housing may be configured to accommodate a magnetic circuit assembly. In some embodiments, the panel (e.g., the panel 301) and the housing panel may be of the same structure, and each of the panel and the housing panel may be in contact with a human body and configured to transmit a sound to the human body. The driving device 101 may be the same as or similar to the headphone core described in the above embodiments.

In some embodiments, the driving device 101 may transmit a vibration signal to the panel 301 and/or the housing 302 through the transmission assembly 303, thereby transmitting the sound to the human body via the contact between the panel 301 and the human body or between the housing 302 and the human body. In some embodiments, the panel 301 and/or the housing 302 of the speaker device 1510 may be in contact with the human body at the tragus. In some embodiments, the panel 301 and/or the housing 302 may be in contact with the human body on the rear side of the auricle.

As shown in FIG. 15, in some embodiments, a line B (or a vibration direction of the driving device 101) where a driving force generated by the driving device 101 locates may form an angle θ with a normal line A of the panel 301, that is, the line B and the normal line A of the panel 301 may be not parallel.

Further, the panel 301 may include an area, and the area may be in contact or abut against the human body (e.g., the human skin). In some embodiments, the panel 301 may be covered with other materials (e.g., a soft material such as silicone), thereby improving the wearing comfortability of the human body. In this case, the panel 301 may be not in contact with the human body, and the panel 301 may abut against the human body. In some embodiments, the entire or a portion of the panel 301 may be in contact with the human body. In some embodiments, the area which may be in contact or abut against the human body may account more than 50% of an area of the panel 301. Preferably, the area which may be in contact or abut against the human body may account for more than 60% of the area of the panel 301. In some embodiments, the area which may be in contact or abut against the human body may include a flat surface, a curved surface, or the like, or any combination thereof.

In some embodiments, when the area on the panel 301, which is in contact with or abuts against the human body, is a flat surface, the normal line of the panel 301 may be a dashed line perpendicular to the flat surface. In some embodiments, when the area on the panel 301, which is in contact with or abuts against the human body, is a curved surface, the normal line of the panel 301 may be an average normal line of the curved surface.

The average normal be represented by Equation (1) below:

$$\hat{r}_0 = \frac{\oiint_S \hat{r}ds}{\left|\oiint_S \hat{r}ds\right|}, \tag{1}$$

where $\hat{r}_0$ represents a normal line, $\hat{r}$ represents a normal line of a point on the curved surface, and ds represents a surface element.

In some embodiments, the curved surface may include a quasi-plane, which may be close to a plane, that is, an angle between a normal line of a point in at least 50% of the area of the curved surface, and the average normal may be less than an angle threshold. In some embodiments, the angle threshold may be less than 10°. In some embodiments, the angle threshold may be less than 5°.

In some embodiments, the line B where the driving force locates and the normal line A' of the area on the panel 301, which is in contact with the human body, may form an angle θ. Preferably, a value of the angle θ may be between 0° and 180°. More preferably, the value of the angle θ may be between 0° and 180° and not equal to 90°. In some embodiments, assuming that the line B has a positive direction pointing out of the speaker device 1510, and the normal line A of the panel 301 (or the normal line A' of the area of the panel 301, which is in contact with the human skin) also has a positive direction pointing out of the speaker device 1510, the angle θ formed between the normal line A and the line B or between the normal line A' and the line B may be an acute angle along the positive direction, that is, the angle θ may be between 0° and 90°.

Figure 16:
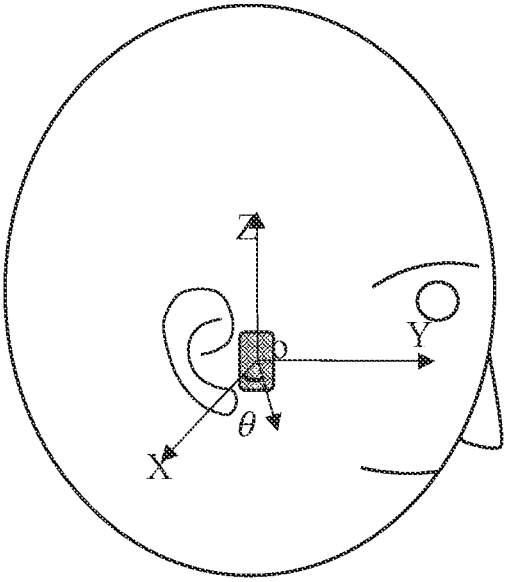
FIG. 16 is a schematic diagram illustrating an exemplary angle direction according to some embodiments of the present disclosure.

FIG. 16 is a schematic diagram illustrating an exemplary angle direction according to some embodiments of the present disclosure. As shown in FIG. 16, in some embodiments, a driving force generated by a driving device 101 may have a first component in the first quadrant of an XOY plane coordinate system and/or a second component in the third quadrant of the XOY plane coordinate system. In some embodiments, the XOY plane coordinate system may include a reference coordinate system. An origin O of the XOY plane coordinate system may be located on a contact surface between a panel and/or a housing of the speaker and the human body after a speaker device is worn on a human body. An X-axis of the XOY plane coordinate system may be parallel to a coronal axis of the human body. A Y-axis of the XOY plane coordinate system may be parallel to a sagittal axis of the human body. A positive direction of the X-axis may face outside of the human body, and a positive direction of the Y-axis may face the front of the human body. Quadrants refer to four regions divided by a horizontal axis (e.g., the X-axis of the XOY plane) and a vertical axis (e.g., the Y-axis of the XOY plane) in a rectangular coordinate system. Each of the four regions is called a quadrant. The quadrant may be centered at an origin, and the horizontal axis and the vertical axis may be regarded as dividing lines between the four regions. A relatively upper right region of the four regions (i.e., a region enclosed by a positive half axis of the horizontal axis and a positive half axis of the vertical axis) of the four regions may be regarded as a first quadrant. A relatively upper left region of the four regions (e.g., a region enclosed by a negative half axis of the horizontal axis and a positive half axis of the vertical axis) of the four regions may be regarded as a second quadrant. A relatively low left region (i.e., a region enclosed by the negative half axis of the horizontal axis and a negative half axis of the vertical axis) of the four regions may be regarded as a third quadrant. A relatively low right region (i.e., a region enclosed by the positive half axis of the horizontal axis and the negative half axis of the vertical axis) of the four regions may be regarded as a fourth quadrant. Each of points at a coordinate axis (e.g., the horizontal axis or the vertical axis) does not belong to any quadrant. It should be understood that a driving force in some embodiments may be located in the first quadrant and/or third quadrant of the XOY plane coordinate system, or the driving force may be directed in other directions, a projection or component of the driving force may be in the first quadrant and/or the third quadrant of the XOY plane coordinate system, and a projection or component of the driving force in a Z-axis direction may be zero or not zero, wherein the Z-axis may be perpendicular to the XOY plane and pass through the origin O. In some embodiments, a relatively small angle θ between a line where the driving force locates and a normal line of an area of a panel of a speaker device, which is in contact with or abuts against a user's body may be any acute angle. For example, a range of the angle θ may be 5°~80°. Preferably, the range of the angle θ may be 15°~70°. More preferably, a range of the angle θ may be 25°~60°. More preferably, the range of the angle θ may be 25°~50°. More preferably, the range of the angle θ may be 28°~50°. More preferably, the range of the angle θ may be 30°~39°. More preferably, the range of the angle θ may be 31°~38°. More preferably, the range of the angle θ may be 32°~37°. More preferably, the range of the angle θ may be 33°~36°. More preferably, the range of the angle θ may be 33°~35.8°. More preferably, the range of the angle θ may be 33.5°~35°. In some embodiments, the angle θ may be 26°, 27°, 28°, 29°, 30°, 31°, 32°, 33°, 34°, 34.2°, 35°, 35.8°, 36°, 37°, 38°, etc., and an error of the angle θ may be controlled within 0.2°. It should be noted that the driving force described above should not be regarded as a limitation of the driving force in the present disclosure. In some embodiments, the driving force may have one or more components in the second and/or the fourth quadrants of the XOY plane coordinate system. In some embodiments, the driving force may be located on the Y-axis.

Figure 17:
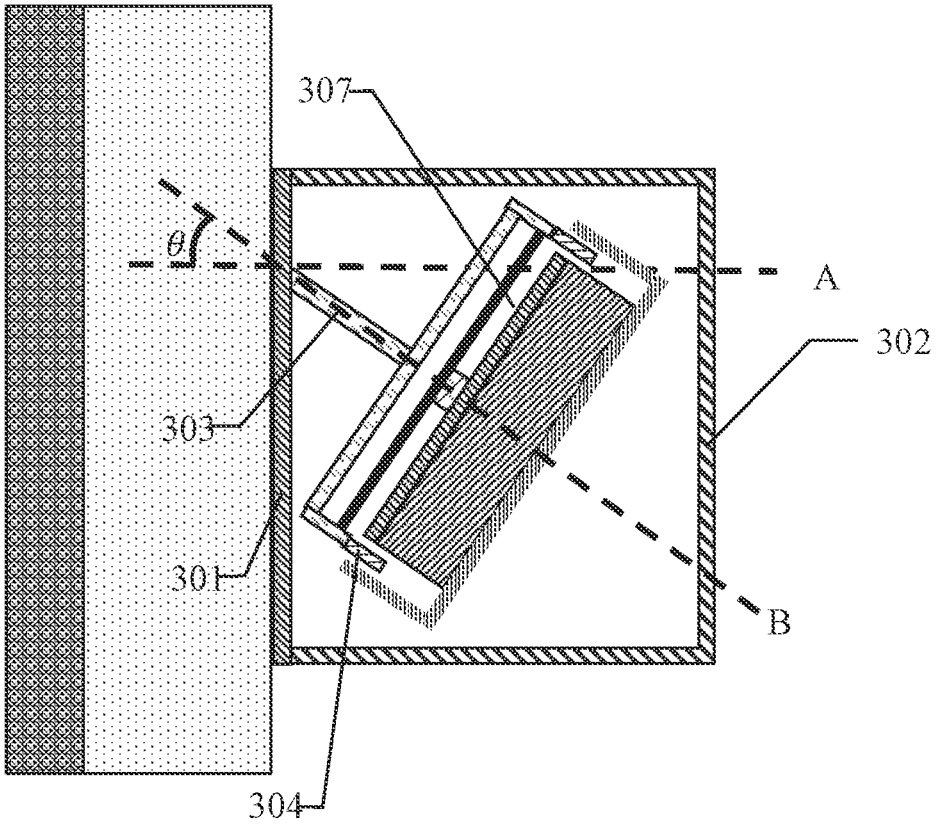
FIG. 17 is a schematic diagram illustrating an exemplary speaker device acting on human skin or bones according to some embodiments of the present disclosure.

FIG. 17 is a schematic diagram illustrating an exemplary speaker device acting on human skin or bones according to some embodiments of the present disclosure. As shown in FIG. 17, the speaker device may include a driving device 101 (also referred to as a transducer device, not shown in FIG. 17), a transmission assembly 303, a panel 301, and a housing 302.

In some embodiments, a line where a driving force of the speaker device locates may be collinear or parallel to a line where the drive device 101 vibrates. For example, in the driving device 101, a direction of a driving force may be the same as or opposite to a vibration direction of the coil and/or a magnetic circuit assembly based on the moving coil principle. In some embodiments, the panel 301 may include a flat surface or a curved surface. In some embodiments, the panel 301 may include a plurality of protrusions and/or grooves. In some embodiments, after the speaker device is worn on a user body, a normal line of an area on the panel 301 that is in contact with or abuts against the user's body may be not parallel to the line where the driving force locates. Generally speaking, the area on the panel 301 that is in contact with or abuts against the user's body may be relatively flat. Specifically, the area on the panel 301 that is in contact with or abuts against the user's body may include a plane or a quasi-plane with a relatively small curvature. When the area on the panel 301 configured to contact or abut against the user's body is a plane, a normal line of any point on the area may be regarded as the normal line of the area. When the area on the panel 301 configured to contact the user's body is non-planar, the normal line of the area may include an average normal line of the area. In this case, a normal line A of the panel 301 and a normal A' of the area of the panel 301 contacted with the human skin may be parallel or coincident with each other. More descriptions regarding the average normal line may be found elsewhere in the present disclosure. See, e.g., FIG. 15 and the relevant descriptions thereof. In some other embodiments, when the area configured to contact the user's body on the panel 301 is non-planar, the normal line of the area may be determined according to the following operations. A point in an area of the panel 301 may be determined. The area of the panel 301 may contact with the human skin. A tangent plane of the panel 301 at the point may be determined, and a line perpendicular to the tangent plane through the point may be determined. The line may be regarded as a normal line of the panel 301. When the entire or a portion of the panel 301 which is connected with the human skin is a non-planar, selected points may be different, tangent planes at the selected points may be different, and normal lines corresponding to the tangent planes may be different. In this case, the normal line A' of the normal lines may be not parallel to the normal A of the panel. According to some embodiments of the present disclosure, an angle θ may be formed between the line where the driving force locates (or the line where the drive device 101 vibrates) and the normal line of the area, and the angle θ may be granter than 0 and less than 180°. In some embodiments, a direction of the driving force from the panel (or the contact surface of the panel and/or the housing connected with the human skin) to the outside of the speaker device may be assumed as a positive direction of the line where the driving force locates, a direction of the normal line pointing outward the panel (or a connect surface of the panel 301 and/or the housing 302 connected with the human skin) may be assumed as a positive direction of the normal line, accordingly, the angle θ may be an acute angle. As shown in FIG. 17, in some embodiments, each of the coil 304 and the magnetic circuit assembly 307 may include a ring-shaped structure. In some embodiments, an axis of the coil 304 and an axis of the magnetic circuit assembly 307 may be parallel to each other. The axis of the coil 304 or the axis of the magnetic circuit assembly 307 may be perpendicular to a radial plane of the coil 304 and/or a radial plane of the magnetic circuit assembly 307. In some embodiments, the coil 304 and the magnetic circuit assembly 307 may have the same central axis. The central axis of the coil 304 may be perpendicular to the radial plane of the coil 304 and pass through a geometric center of the coil 304. The central axis and the radial plane of the circuit assembly 307 may be vertical to each other, and the central axis of the magnetic circuit assembly 307 may pass through the geometric center of the magnetic circuit assembly 307. The axis of the coil 304 or the axis of the magnetic circuit assembly 307 and the normal of the panel 301 may form the aforementioned angle θ.

In some embodiments, the magnetic circuit assembly described in the above embodiments may be of the same structure, which may refer to a structure that provides a magnetic field. The coils described in the above embodiments may be of the same structure, which may refer to a structure that can receive an external electrical signal and convert the electrical signal into a mechanical vibration signal under the action of the magnetic field.

Merely by way of example, a relationship between a driving force and skin deformation may be described in connection with FIG. 17. When a line where the driving forced locates, which is generated by the driving device 101, is parallel to the normal line of the panel 301 (i.e., the angle θ is equal to zero), the relationship between the driving force and the total skin deformation may be represented by Equation (2)

$$F_{\perp}=S_{\perp}\times E\times A/h \tag{2}$$

Where $F_{\perp}$ represents the driving force, $S_{\perp}$ represents the total skin deformation along a direction perpendicular to the skin, E represents an elastic modulus of the skin, A represents the contact area between the panel 301 and the skin, and h represents a total thickness of the skin (that is, a distance between the panel and the bone).

When the line where the driving force of the driving device 101 locates is perpendicular to the normal of the area on the panel 301, which is in contact with or abut against the user's body (i.e., the angle is 90°), the relationship between a driving force in the vertical direction and the total skin deformation may be represented by Equation (3) below:

$$F_{//}=S_{//}\times G\times A/h \tag{3}$$

Where $F_{//}$ represents the driving force in the vertical direction, $S_{//}$ represents a total skin deformation along a direction parallel to the skin, G represents a shear modulus of the skin, A represents the contact area between the panel 301 and the skin, and h represents the total thickness of the skin (i.e., the distance between the panel and the bone).

A relationship between shear modulus and elastic modulus may be represented by Equation (4) below:

$$G=E/2(1+\gamma) \tag{4}$$

where γ represents the Poisson's ratio of the skin, $0<\gamma<0.5$, the shear modulus is less than the elastic modulus, and $S_{//}>S_{\perp}$ under the same driving force. Generally, the Poisson's ratio of the skin may be close to 0.4.

When the line where the driving device 101 locates is not parallel to the normal line of the area where the panel 301 is in contact with the user's body, a driving force along a horizontal direction and the driving force along the vertical direction may be represented by Equation (5) and Equation (6), respectively:

$$F_{\perp}=F\times\cos(\theta) \tag{5}$$

$$F_{//}=F\times\sin(\theta) \tag{6}$$

wherein the relationship between driving force F and skin deformation s may be represented by Equation (7) below:

$$S=\sqrt[2]{S_{\perp}^2+S_{//}^2}=\frac{h}{A}\times F\times\sqrt[2]{(\cos(\theta)/E)^2+(\sin(\theta)/G)^2} \tag{7}$$

When the Poisson's ratio of the skin is 0.4, a relationship between the angle θ and the total skin deformation may be found elsewhere in the present disclosure. See, e.g., FIG. 18 and the relevant descriptions thereof.

Figure 18:
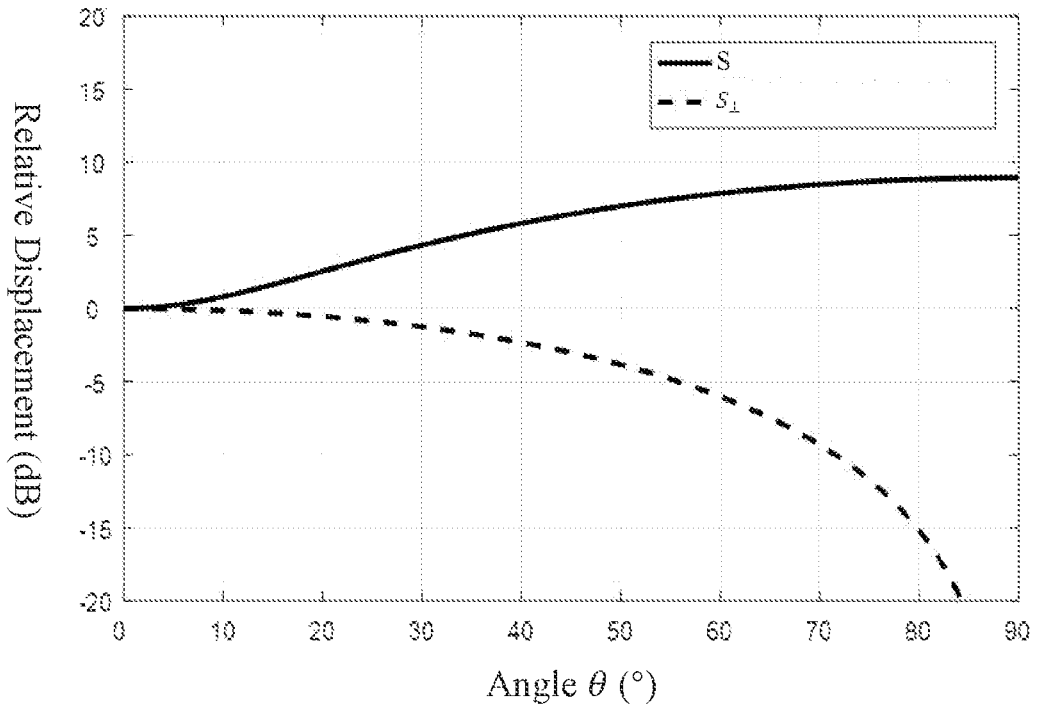
FIG. 18 is a schematic diagram illustrating a relationship between an angle and a relative displacement of an exemplary speaker device according to some embodiments of the present disclosure.

FIG. 18 is a schematic diagram illustrating a relationship between an angle and a relative displacement of an exemplary speaker device according to some embodiments of the present disclosure. As shown in FIG. 18, a relationship between an angle and a total deformation of the skin may be that the greater angle and/or the greater the relative displacement is, the greater the total deformation is. A skin deformation $S_{\perp}$ perpendicular to the skin may decrease as the angle θ increases, and/or the relative displacement decreases. When the angle θ is close to 90°, the deformation $S_{\perp}$ may gradually tend to zero.

In some embodiments, a part of a volume of the speaker device in a low frequency may be a positive correlation with the total skin deformation S. The greater the S is, the greater the part of the volume in the low frequency is. A part of the volume of the loudspeaker device in a high frequency may be a positive correlation with the total skin deformation $S_{\perp}$. The greater the total skin deformation $S_{\perp}$ is, the greater the part of the volume in the high frequency is.

Further, when the Poisson's ratio of the skin is 0.4, more descriptions regarding the relationship between the angle θ, the total skin deformation S, and the $S_{\perp}$ may be described in FIG. 18. As shown in FIG. 18, the relationship between the angle θ and the total skin deformation S may be that the greater the angle θ is, the greater the total skin deformation S is, and accordingly, the greater the part of the volume of the loudspeaker device in the low frequency is. As shown in FIG. 18, the relationship between the angle θ and the total skin deformation S may be that the greater the angle θ is, the less the t $S_{\perp}$ is, and accordingly, the less the part of the volume in the high frequency is.

As shown in Equation (7) and FIG. 18, an increasing speed of the total skin deformation S and a decreasing speed of the $S_{\perp}$ may be different. The increasing speed of the total skin deformation S may be from a relatively fast speed to a relatively slow speed. The decreasing speed of the $S_{\perp}$ may be faster and faster. The angle θ may be determined to balance the part of the volume of the speaker device in the low frequency and the part of the volume of the speaker device in the high frequency. For example, a range of the angle θ may be 5°~80°, 15°~70°, 25°~50°, 25°~35°, 25°~30°, or the like.

Figure 19:
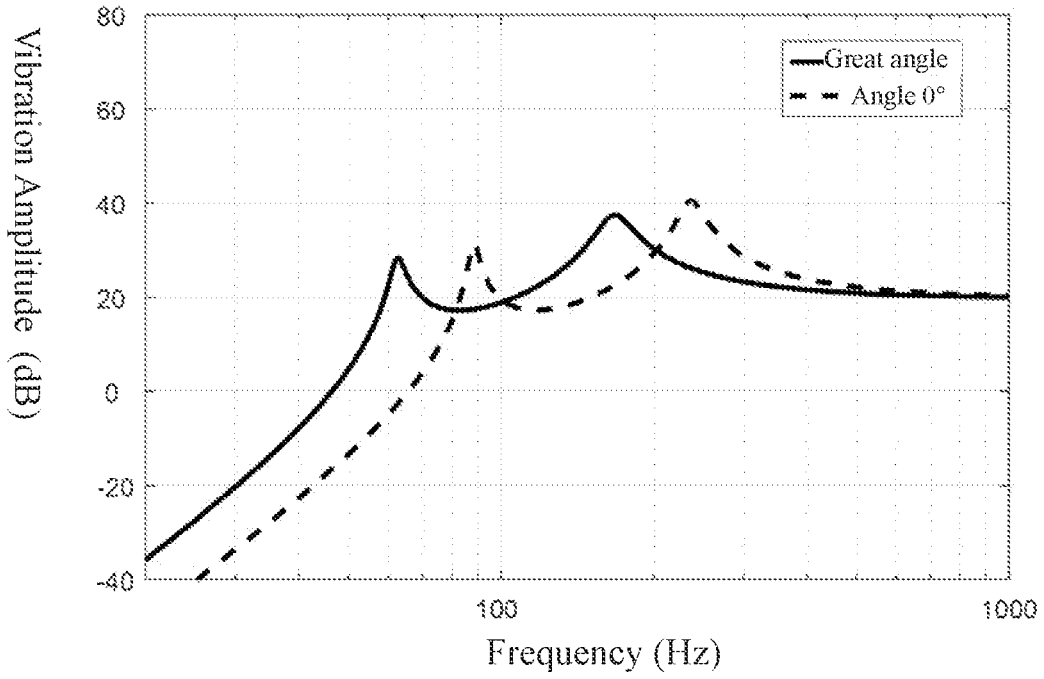
FIG. 19 is a schematic diagram illustrating a low frequency part of a frequency response curve of an exemplary speaker device corresponding to different angles θ according to some embodiments of the present disclosure.

FIG. 19 is a schematic diagram illustrating a low frequency part of a frequency response curve of an exemplary speaker device corresponding to different angles θ according to some embodiments of the present disclosure. As shown in FIG. 19, a panel 301 is in contact with the skin and transmits vibration to the skin. In this process, the skin may affect the vibration of the speaker device, thereby affecting the frequency response curve of the speaker device. As the descriptions described above, the greater the angle θ is, the greater the total skin deformation is under a same driving force. For the speaker device, the total skin deformation may be equivalent to the reduction of the elasticity of the skin relative to the panel 301. It can be understood that when a line where the driving force of the driving device 101 locates and a normal line of an area of the panel 301, which is connected or abut against a user's body may form the angle θ, in particular, when the angle θ increases, a resonance peak of the low frequency part in the frequency response curve may be adjusted to a relatively low frequency part, thereby lowing the low frequency dive deeper and increasing the low frequency. Compared with other technical means to improve the low-frequency components of a sound, for example, adding a vibration plate to the speaker device, setting the angle θ to improve the low frequency energy may effectively reduce the vibration sense, further significantly improving the low frequency sensitivity of the speaker device, the sound quality, and the human experience. It should be noted that, in some embodiments, the increased low frequency and the reduced vibration sense may be represented by that when the angle θ increases in the range of (0, 90°), the energy of the vibration or sound signal in the low frequency range increases, and the vibration sense may be increased. The increasement of the energy in the low-frequency range may be greater than the increasement of the vibration sense. For relative effects, the vibration sense may be relatively reduced. It can be seen from FIG. 19 that when the angle θ is relatively great, the resonance peak in the low frequency area may appear in a relatively low frequency range, which may extend a flat part of the frequency curvature in disguise, thereby improving the sound quality of the speaker device.

It should be noted that the above descriptions regarding the speaker device are only some specific examples and should not be regarded as the only feasible implementations. Obviously, for those skilled in the art, after understanding the basic principle of the speaker device, it is possible to make various modifications and changes in forms and details to the implementation mode of the speaker device. However, those variations, changes, and modifications do not depart from the scope of the present disclosure. For example, the minimum angle θ between the line where the driving force locates and the normal line of the area on the panel that is in contact with or abuts against the user's body may be any acute angle, and the acute angle here is not limited to the above described 5°~80°. In some embodiments, the angle θ may be less than 5°, such as 1°, 2°, 3°, 4°, etc. In some embodiments, the angle θ may be greater than 80° and less than 90°, such as 81°, 82°, 85°, etc. In some embodiments, the specific value of the angle θ may not be an integer (e.g., 81.3°, 81.38°, etc.). Such variations are all within the protection scope of the present disclosure.

Figure 20:
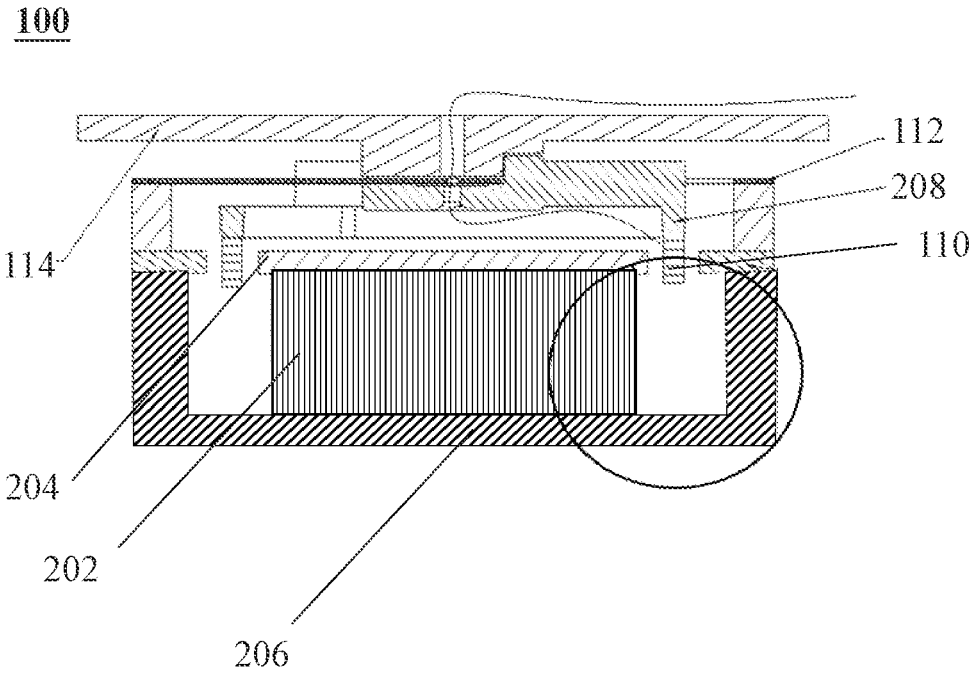
FIG. 20 is a schematic diagram illustrating a longitudinal cross-sectional of an exemplary speaker device according to some embodiments of the present disclosure.

FIG. 20 is a schematic diagram illustrating a longitudinal cross-sectional of an exemplary speaker device according to some embodiments of the present disclosure. It should be understood that the following descriptions described below can also be applied to an air conduction speaker device and a bone conduction speaker device without violating the principle.

As shown in FIG. 20, in some embodiments, the speaker device may include a first magnetic element 202, a first magnetically conductive element 204, a second magnetically conductive element 206, a first vibration plate 208, a voice coil 110, a second vibration plate 112, and a vibration panel 114. In some embodiments, one or more components of a headphone core of a bone conduction speaker device may form a magnetic circuit assembly. In some embodiments, the magnetic circuit assembly may include a first magnetic element 102, a first magnetically conductive element 104, and a second magnetically conductive element 106. The magnetic circuit assembly may generate a first full magnetic field (also referred to as a total magnetic field of the magnetic circuit assembly or a first magnetic field).

A magnetic element described in the present disclosure refers to an element that generates a magnetic field, such as magnets. The magnetic element may have a magnetization direction, and the magnetization direction refers to a direction of a magnetic field inside the magnetic element. In some embodiments, the first magnetic element 202 may include one or more magnets, and the first magnetic element may generate a second magnetic field. In some embodiments, the magnet may include a metal alloy magnet, ferrite, or the like. The metal alloy magnet may include neodymium iron boron, samarium cobalt, aluminum nickel cobalt, iron chromium cobalt, aluminum iron boron, iron carbon aluminum, or the like, or any combination thereof. The ferrite may include barium ferrite, steel ferrite, manganese ferrite, lithium manganese ferrite, or the like, or any combination thereof.

In some embodiments, a lower surface of the first magnetically conductive element 204 may be connected to an upper surface of the first magnetic element 202. The second magnetically conductive element 206 may be connected to the first magnetic element 202. It should be noted that a magnetically conductive element is also referred to as a magnetic field concentrator or an iron core. The magnetic conductor may adjust the distribution of a magnetic field (e.g., the second magnetic field generated by the first magnetic element 202). The magnetic conductor may include an element processed from soft magnetic material. In some embodiments, the soft magnetic material may include metal material, metal alloy, metal oxide material, amorphous metal material, etc., such as iron, iron-silicon alloy, iron-aluminum alloy, nickel-iron alloy, iron-cobalt alloy, low carbon steel, silicon steel sheet, silicon steel sheet, ferrite, etc. In some embodiments, the magnetically conductive element may be processed by casting, plastic processing, cutting processing, powder metallurgy, or the like, or any combination thereof. The casting may include sand casting, investment casting, pressure casting, centrifugal casting, etc. The plastic processing may include rolling, casting, forging, stamping, extrusion, drawing, etc. The cutting processing may include turning, milling, planing, grinding, etc. In some embodiments, the processing of the magnetically conductive element may also include 3D printing, numerically-controlled machine tools, and the like. A connection between the first magnetically conductive element 204, the second magnetically conductive element 206, and the first magnetic element 202 may include bonding, clamping, welding, riveting, bolting, or the like, or any combination thereof. In some embodiments, the first magnetic element 202, the first magnetically conductive element 204, and the second magnetically conductive element 206 may be arranged in an axisymmetric structure. The axisymmetric structure may be a ring structure, a columnar structure, or other axisymmetric structures.

In some embodiments, a magnetic gap may be formed between the first magnetic element 202 and the second magnetically conductive element 206. The voice coil 110 may be disposed in the magnetic gap. The voice coil 110 may be connected to the first vibration plate 208. The first vibration plate 208 may be connected to the second vibration plate 112, and the second vibration plate 112 may be connected to the vibration panel 114. When current is applied to the voice coil 110, the voice coil 110 may be located in a magnetic field formed by the first magnetic element 202, the first magnetically conductive element 204, and the second magnetically conductive element 206, and subjected to ampere force. The ampere force may drive the voice coil 110 to vibrate, and the vibration of the voice coil 110 may drive the first vibration plate 208, the second vibration plate 112, and the vibration panel 114 to vibrate. The vibration panel 114 may transmit the vibration to the auditory nerve through the tissues and bones so that a user can hear a sound. The vibration panel 114 may directly contact the user's skin or may contact the user's skin through a vibration transmission layer composed of a specific material.

In some embodiments, for a speaker device with a single magnetic element, the magnetic induction lines passing through the voice coil 110 may be not uniform and divergent. In addition, magnetic leakage may be formed in the magnetic circuit, that is, some magnetic induction lines may leak out of the magnetic gap and fail to pass through the voice coil 110, thereby reducing the magnetic induction intensity (or magnetic field intensity) at the position of the voice coil 110, and affecting the sensitivity of the speaker device. The speaker device may further include at least one second magnetic element and/at least one third magnetic element (not shown in the figure). The at least one second magnetic element and/or the at least one third magnetic element may suppress the leakage of the magnetic induction lines, and restrict the shape of the magnetic induction lines passing through the voice coil 110, so that relatively more magnetic induction lines may horizontally and densely pass through the voice coil 110, thereby improving the magnetic induction intensity (or magnetic field intensity) at the position of the voice coil 110, the sensitivity of the speaker device, and the mechanical conversion efficiency of the speaker device (i.e., the efficiency of converting the electrical energy inputted into the speaker device 100 into the mechanical energy of the voice coil 110).

Figure 21:
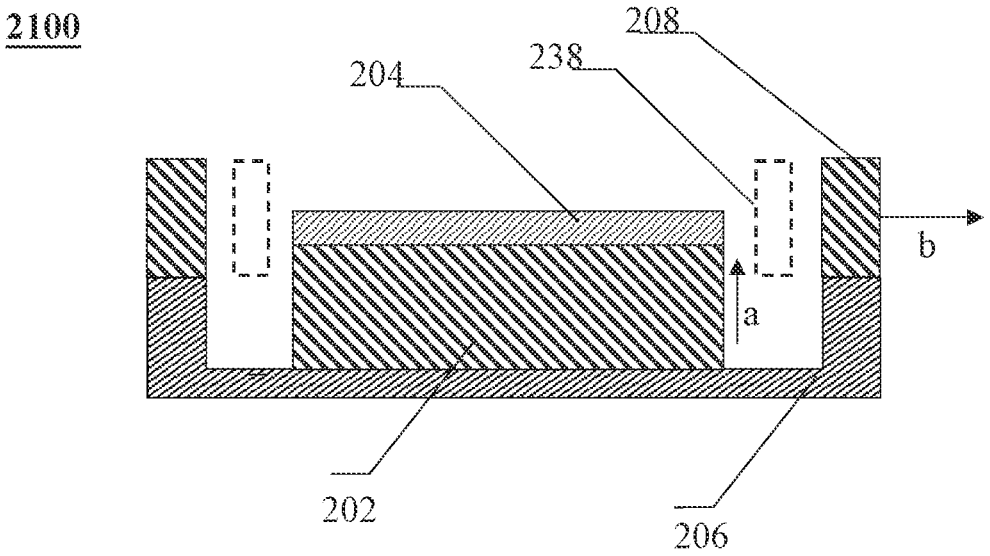
FIG. 21 is a schematic diagram illustrating a longitudinal cross-sectional of an exemplary magnetic circuit assembly according to some embodiments of the present disclosure.

FIG. 21 is a schematic diagram illustrating a longitudinal cross-sectional of an exemplary magnetic circuit assembly according to some embodiments of the present disclosure. As shown in FIG. 21, the magnetic circuit assembly 2100 may include a first magnetic element 202, a first magnetically conductive element 204, a second magnetically conductive element 206, and a second magnetic element 208.

In some embodiments, the magnetic circuit assembly described in the above embodiments may be of the same structure, which may refer to a structure that provides a magnetic field. In some embodiments, the first magnetic element 202 and/or the second magnetic element 208 may include any one or several types of magnets described in the present disclosure. In some embodiments, the first magnetic element 202 may include a first magnet, and the second magnetic element 208 may include a second magnet. The first magnet and the second magnet may be the same or different. The first magnetically conductive element 204 and/or the second magnetically conductive element 206 may include one or more of the magnetically conductive materials described in the present disclosure. A processing manner of the first magnetically conductive element 204 and/or the second magnetically conductive element 206 may include any one or several processing manners described in the present disclosure. In some embodiments, the first magnetic element 202 and/or the first magnetically conductive element 204 may include an axisymmetric structure. For example, the shape of the first magnetic element 202 and/or first magnetically conductive element 204 may be a cylinder, a rectangular parallelepiped, or a hollow ring shape (e.g., with a cross section in the shape of a racetrack). In some embodiments, the first magnetic element 202 and the first magnetically conductive element 204 may be coaxial cylinders with the same or different diameters. In some embodiments, the second magnetically conductive element 206 may include a groove-type structure. The groove-type structure may include a U-shaped section (as shown in FIG. 21). The groove-shaped second magnetically conductive element 206 may include a bottom plate and a side wall. In some embodiments, the bottom plate and the side wall may be integrally formed. For example, the side wall may be formed by extending the bottom plate along a direction perpendicular to the bottom plate. In some embodiments, the bottom plate may be connected to the side wall via one or more connection manners described according to some embodiments of the present disclosure. A shape of the second magnetic element 208 may include a ring, a sheet, etc. In some embodiments, the shape of the second magnetic element 208 may be a ring. The second magnetic element 208 may include an inner ring and an outer ring. In some embodiments, the shape of the inner ring and/or the outer ring may be a circle, an ellipse, a triangle, a quadrilateral, or other polygons. In some embodiments, the second magnetic element 208 may be formed by arranging a plurality of magnets. Two ends of each of the plurality of magnets may be connected to two ends of an adjacent magnet or a distance may be formed between two adjacent magnets of the plurality of magnets. The distance between each two adjacent magnets of the plurality of magnets may be the same or different. In some embodiments, the magnetic element may be formed by arranging two or three piece-shaped magnets equidistantly. A shape of the sheet-shaped magnet may include a fan, a quadrangle, etc. In some embodiments, the second magnetic element 208 may be coaxial with the first magnetic element 202 and/or the first magnetically conductive element 204.

Further, the upper surface of the first magnetic element 202 may be connected to the lower surface of the first magnetically conductive element 204. The lower surface of the first magnetic element 202 may be connected to the bottom plate of the second magnetically conductive element 206. The bottom surface of the second magnetic element 208 may be connected to the side wall of the second magnetically conductive element 206. The connection between the first magnetic element 202, the first magnetically conductive element 204, the second magnetically conductive element 206, and/or the second magnetic element 208 may include a bonding connection, a clamping connection, a welding connection, a riveting connection, a bolting connection, or the like, or any combination thereof.

In some embodiments, a magnetic gap may be formed between the inner ring of the first magnetic element 202 and/or the first magnetically conductive element 204 and the second magnetic element 208. The voice coil 238 may be disposed in the magnetic gap. In some embodiments, a height of the voice coil 238 of the second magnetic element 208 relative to the bottom plate of the second magnetically conductive element 206 may be equal.

In some embodiments, the first magnetic element 202, the first magnetically conductive element 204, the second magnetically conductive element 206, and the second magnetic element 208 may form a magnetic circuit. In some embodiments, the magnetic circuit assembly 2100 may generate a first full magnetic field (also referred to as "total magnetic field of the magnetic circuit assembly" or a "first magnetic field"), and the first magnetic element 202 may generate a second magnetic field. The first full magnetic field may be formed by magnetic fields generated by one or more components (e.g., the first magnetic element 202, the first magnetically conductive element 204, the second magnetically conductive element 206, and/or the second magnetic element 208) of the magnetic circuit assembly 2100.

In some embodiments, a magnetic field intensity (also referred to as a magnetic induction or a magnetic flux density) of the first full magnetic field in the magnetic gap may be greater than a magnetic field intensity of the second magnetic field in the magnetic gap. In some embodiments, the second magnetic element 208 may generate a third magnetic field, which may improve the magnetic field intensity of the first full magnetic field at the magnetic gap. The improvement of the magnetic field intensity of the first full magnetic field caused by the third magnetic field mentioned may refer to that when the third magnetic field exists (i.e., the second magnetic element 208 exists), the magnetic field intensity of the first full magnetic field in the magnetic gap may be greater than that when the third magnetic field does not exist (i.e., the second magnetic element 208 does not exist). In other embodiments of the present disclosure, unless otherwise specified, the magnetic circuit assembly refers to a structure that may include one or more of the magnetic elements and the magnetically conductive element. The first full magnetic field refers to the magnetic field generated by the magnetic circuit assembly as a whole, and the second magnetic field, the third magnetic field, . . . , or the $N^{th}$ magnetic field refers to a magnetic field generated by a corresponding magnetic element. In different embodiments, the magnetic elements that generate the second magnetic fields (the third magnetic field, . . . , or the $N^{th}$ magnetic field) may be the same or different.

In some embodiments, the voice coils described in the above embodiments may be of the same structure, which may refer to a structure that transmits audio signals. In some embodiments, the magnetic circuit assembly described in the above embodiments may be of the same structure, which c.

In some embodiments, an angle between a magnetization direction of the first magnetic element 202 and a magnetization direction of the second magnetic element 208 may be between 0° and 180°. In some embodiments, the angle between the magnetization direction of the first magnetic element 202 and the magnetization direction of the second magnetic element 208 may be between 45° and 135°. In some embodiments, the angle between the magnetization direction of the first magnetic element 202 and the magnetization direction of the second magnetic element 208 may be equal to or greater than 90°. In some embodiments, the magnetization direction of the first magnetic element 202 may vertically upwards and be perpendicular to the lower surface or the upper surface of the first magnetic element 202 (e.g., a direction indicated by the arrow a in FIG. 21). The magnetization direction of the second magnetic element 208 may be from the inner ring to the outer ring of the second magnetic element 208 (e.g., a direction indicated by the arrow b in FIG. 21, that is, on a right side of the first magnetic element 202, the magnetization direction of the first magnetic element 202 may be deflected by 90° in the clockwise direction).

In some embodiments, at a position of the second magnetic element 208, the angle between the direction of the first full magnetic field and the magnetization direction of the second magnetic element 208 may be not greater than 90°. In some embodiments, at the position of the second magnetic element 208, the angle between the direction of the magnetic field generated by the first magnetic element 202 and the magnetization direction of the second magnetic element 208 may be equal to or less than 90°, such as 0°, 10°, or 20°, etc. Further, compared with a magnetic circuit assembly of a single magnetic element, the second magnetic element 208 may increase a total magnetic flux in the magnetic gap in the magnetic circuit assembly 2100, thereby increasing the magnetic induction intensity in the magnetic gap. In addition, under the action of the second magnetic element 208, originally diverging magnetic lines of force may converge to the position of the magnetic gap, further increasing the magnetic induction intensity in the magnetic gap.

Figure 22:
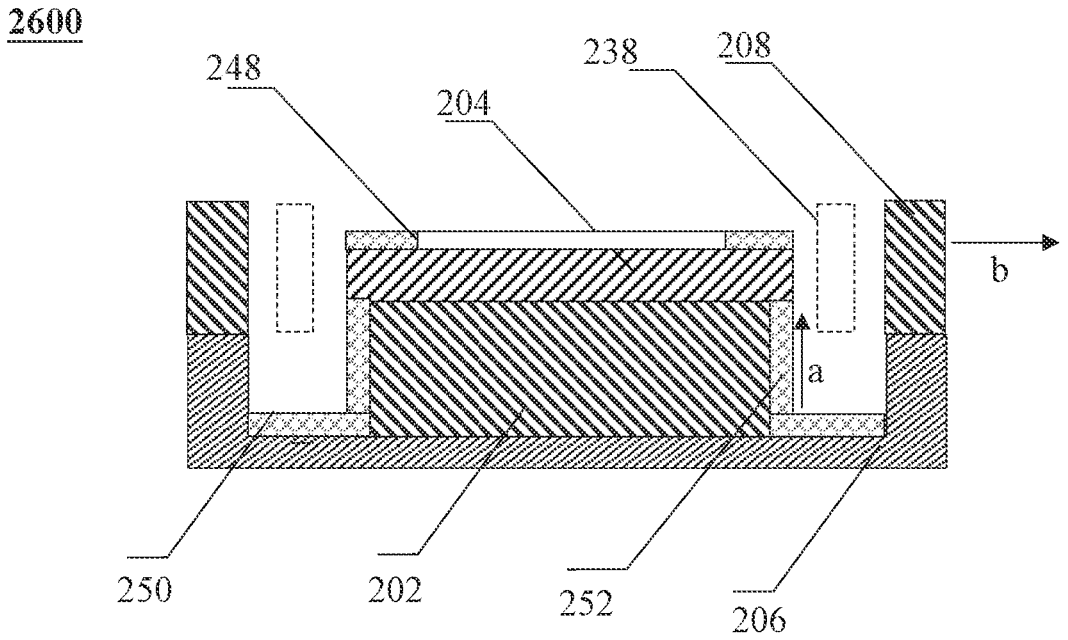
FIG. 22 is a schematic diagram illustrating a longitudinal cross-sectional of an exemplary magnetic circuit assembly according to some embodiments of the present disclosure.

FIG. 22 is a schematic diagram illustrating a longitudinal cross-sectional of an exemplary magnetic circuit assembly according to some embodiments of the present disclosure. As shown in FIG. 22, the magnetic circuit assembly 2600 may be similar to the magnetic circuit assembly 2100 except that the magnetic circuit assembly 2600 may include at least one conductive element (e.g., a first conductive element 248, a second conductive element 250, or a third conductive element 252).

In some embodiments, each of the at least one conductive element may include a metallic material, metallic alloy material, inorganic non-metallic material, or other conductive materials. The metallic material may include gold, silver, copper, aluminum, etc. The metallic alloy material may include iron-based alloy material, aluminum-based alloy material, copper-based alloy material, zinc-based alloy material, etc. The inorganic non-metallic material may include graphite, etc. A shape of the conductive element may include a sheet, a ring, a mesh, etc. The first conductive element 248 may be disposed on the upper surface of the first magnetically conductive element 204. The second conductive element 250 may be connected to the first magnetic element 202 and the second magnetically conductive element 206. The third conductive element 252 may be connected to the sidewall of the first magnetic element 202. In some embodiments, the first magnetically conductive element 204 may protrude from the first magnetic element 202 to form a first recess, and the third conductive element 252 may be disposed in the first recess. In some embodiments, the first conductive element 248, the second conductive element 250, and the third conductive element 252 may include the same or different conductive materials. The first conductive element 248, the second conductive element 250, and the third conductive element 252 may be connected to the first magnetically conductive element 204, the second magnetically conductive element 206, and/or the first magnetic element 202 via various connection manner described in the present disclosure.

In some embodiments, a magnetic gap is formed between the inner ring of the first magnetic element 202, the first magnetically conductive element 204, and the second magnetic element 208. The voice coil 238 may be disposed in the magnetic gap. The first magnetic element 202, the first magnetically conductive element 204, the second magnetically conductive element 206, and the second magnetic element 208 may form a magnetic circuit. In some embodiments, a conductive element may reduce the inductive reactance of the voice coil 238. For example, when the voice coil 238 is supplied with a first alternating current, a first alternating induced magnetic field may be generated near the voice coil 238. Under the action of the magnetic field in the magnetic circuit, the first alternating induced magnetic field may cause the voice coil 238 to generate inductive reactance and hinder the movement of the voice coil 238. When a conductive element (e.g., the first conductive element 248, the second conductive element 250, or the third conductive element 252) is arranged near the voice coil 238, the conductive element may induce a second alternating current under the action of the first alternating induced magnetic field. The third alternating current in the conductive element may generate a second alternating induced magnetic field in the surroundings of the conductive element. A direction of the second alternating induced magnetic field may be opposite to that of the first alternating induced magnetic field, thereby weakening the first alternating induced magnetic field, reducing the inductive reactance of the voice coil 238, increasing the current in the voice coil, and improving the sensitivity of a speaker device.

Figure 23:
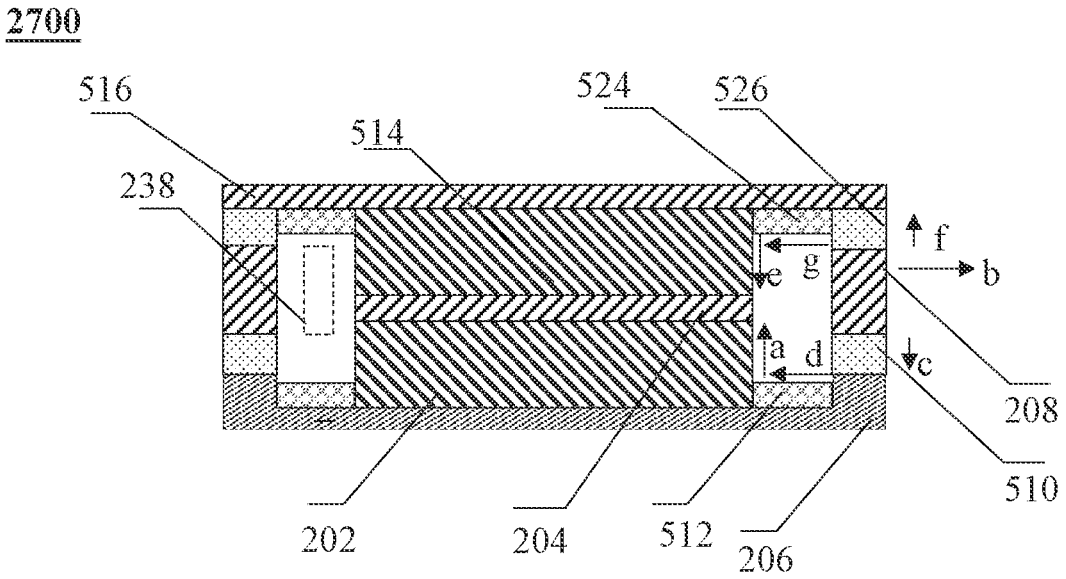
FIG. 23 is a schematic diagram illustrating a longitudinal cross-sectional of an exemplary speaker device according to some embodiments of the present disclosure.

FIG. 23 is a schematic diagram illustrating a longitudinal cross-sectional of an exemplary speaker device according to some embodiments of the present disclosure. As shown in FIG. 23, a magnetic circuit assembly 2700 may be similar to the magnetic circuit assembly 2500 except that the magnetic circuit assembly 2700 may include a third magnetic element 510, a fourth magnetic element 512, a fifth magnetic element 514, a third magnetically conductive element 516, a sixth magnetic element 524, and a seventh magnetically conductive element 526. The third magnetic element 510, the fourth magnetic element 512, the fifth magnetic element 514, the third magnetically conductive element 516, the sixth magnetic element 524, and/or the seventh magnetically conductive element 526 may be arranged as a coaxial annular cylinder.

In some embodiments, the magnetic circuit assembly described in the above embodiments may refer to a structure that provides a magnetic field.

In some embodiments, the upper surface of the second magnetic element 208 may be connected to the seventh magnetically conductive element 526, and the lower surface of the second magnetic element 208 may be connected to the third magnetic element 510. The third magnetic element 510 may be connected to the second magnetically conductive element 206. The upper surface of the seventh magnetically conductive element 526 may be connected to the third magnetically conductive element 516. The fourth magnetic element 512 may be connected to the second magnetically conductive element 206 and the first magnetic element 202. The sixth magnetic element 524 may be connected to the fifth magnetic element 514, the third magnetically conductive element 516, and the seventh magnetically conductive element 526. In some embodiments, the first magnetic element 202, the first magnetically conductive element 204, the second magnetically conductive element 206, the second magnetic element 208, the third magnetic element 510, the fourth magnetic element 512, the fifth magnetic element 514, the third magnetically conductive element 516, the sixth magnetic element 524, and the seventh magnetically conductive element 526 may form a magnetic circuit and a magnetic gap.

In some embodiments, an angle between the magnetization direction of the first magnetic element 202 and a magnetization direction of the sixth magnetic element 524 may be between 0° and 180°. In some embodiments, the angle between the magnetization direction of the first magnetic element 202 and the sixth magnetic element 524 may be between 45° and 135°. In some embodiments, the angle between the magnetization direction of the first magnetic element 202 and the magnetization direction of the sixth magnetic element 524 may be not greater than 90°. In some embodiments, the magnetization direction of the first magnetic element 202 may be perpendicular to the lower surface or the upper surface of the first magnetic element 202 (as indicated by the arrow a in FIG. 22), and the magnetization direction of the sixth magnetic element 524 may be from an outer ring of the sixth magnetic element 524 to an inner ring (as indicated by the arrow g in FIG. 22, that is, on the right side of the first magnetic element 202, the magnetization direction of the first magnetic element 202 may be deflected by 270 degrees in the clockwise direction). In some embodiments, in the same vertical direction, the magnetization direction of the sixth magnetic element 524 and the magnetization direction of the fourth magnetic element 512 may be the same.

In some embodiments, at a position of the sixth magnetic element 524, the angle between the direction of the magnetic field generated by the magnetic circuit assembly 2700 and the magnetization direction of the sixth magnetic element 524 may be not greater than 90°. In some embodiments, at the position of the sixth magnetic element 524, the angle between the direction of the magnetic field generated by the first magnetic element 202 and the magnetization direction of the sixth magnetic element 524 may be equal to or less than 90°, such as 0°, 10°, or 20°, etc.

In some embodiments, the angle between the magnetization direction of the first magnetic element 202 and a magnetization direction of the seventh magnetically conductive element 526 may be between 0° and 180°. In some embodiments, the angle between the magnetization direction of the first magnetic element 202 and the magnetization direction of the seventh magnetically conductive element 526 may be between 45° and 135°. In some embodiments, the angle between the magnetization direction of the first magnetic element 202 and the magnetization direction of the seventh magnetically conductive element 526 may be not greater than 90°. In some embodiments, the magnetization direction of the first magnetic element 202 may be perpendicular to the lower or upper surface of the first magnetic element 202 (as indicated by the arrow a in FIG. 23). A magnetization direction of the seventh magnetically conductive element 526 may be from a lower surface of the seventh magnetically conductive element 526 to an upper surface of the seventh magnetically conductive element 526 (as indicated by the arrow fin FIG. 23, that is, on the right side of the first magnetic element 202, the magnetization direction of the first magnetic element 202 may be deflected by 360° in the clockwise direction). In some embodiments, the magnetization direction of the seventh magnetically conductive element 526 may be opposite to that of the third magnetic element 510.

In some embodiments, at a position of the seventh magnetically conductive element 526, an angle between the direction of the magnetic field generated by the magnetic circuit assembly 2700 and the magnetization direction of the seventh magnetically conductive element 526 may be not greater than 90°. In some embodiments, at the position of the seventh magnetically conductive element 526, the angle between the direction of the magnetic field generated by the first magnetic element 202 and the magnetization direction of the seventh magnetically conductive element 526 may be equal to or less than 90°, such as 0°, 10°, or 20°, etc.

In the magnetic circuit assembly 2700, the third magnetically conductive element 516 may close the magnetic circuit generated by the magnetic circuit assembly 2700, so that relatively more magnetic induction lines are concentrated in the magnetic gap, thereby suppressing magnetic leakage, increasing the magnetic induction at the magnetic gap, and improving the sensitivity of the speaker device.

Figure 24:
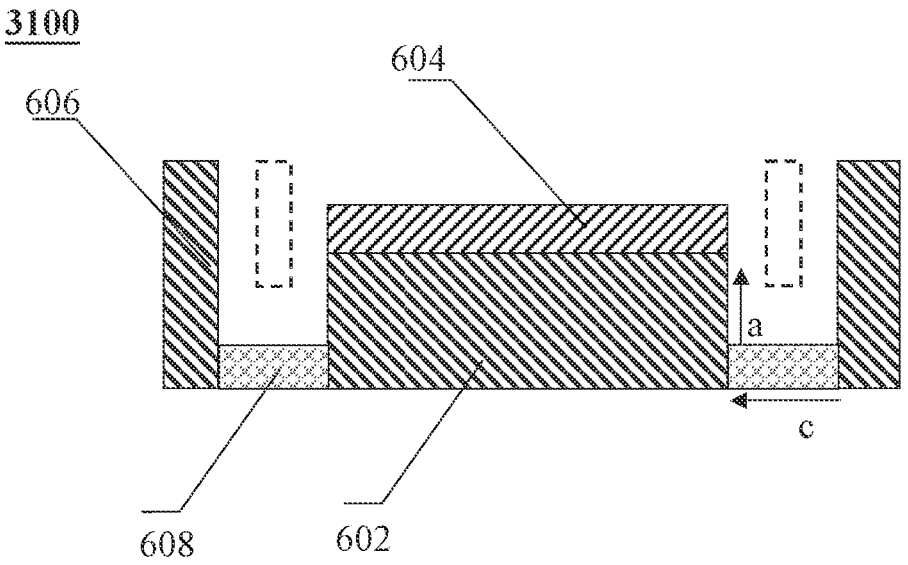
FIG. 24 is a schematic diagram illustrating a longitudinal cross-sectional of an exemplary speaker device according to some embodiments of the present disclosure.

FIG. 24 is a schematic diagram illustrating a longitudinal cross-sectional of an exemplary speaker device according to some embodiments of the present disclosure. As shown in FIG. 24, a magnetic circuit assembly 3100 may include a first magnetic element 602, a first magnetically conductive element 604, a first full magnetic field changing element 606, and a second magnetic element 608.

In some embodiments, the first magnetic element described in the above embodiments may refer to an element of energy storage, energy conversion, and electrical isolation. Similarly, the second magnetic element may also follow this principle. The magnetically conductive element may refer to an element configured to form a magnetic field loop. In some embodiments, an upper surface of the first magnetic element 602 may be connected to a lower surface of the first magnetically conductive element 604, and the second magnetic element 608 may be connected to the first magnetic element 602 and the first full magnetic field changing element 606.

The first magnetic element 602, the first magnetically conductive element 604, the first full magnetic field changing element 606, and/or the second magnetic element 608 may be connected via various connection manners as described in the present disclosure. In some embodiments, the first magnetic element 602, the first magnetically conductive element 604, the first full magnetic field changing element 606, and/or the second magnetic element 608 may form a magnetic circuit and a magnetic gap.

In some embodiments, the magnetic circuit assembly 3100 may generate a first full magnetic field, and the first magnetic element 602 may generate a second magnetic field. The magnetic field intensity of the first full magnetic field in the magnetic gap may be greater than the magnetic field intensity of the second magnetic field in the magnetic gap. In some embodiments, the second magnetic element 608 may generate a third magnetic field, which may improve the magnetic field intensity of the second magnetic field at the magnetic gap.

In some embodiments, an angle between a magnetization direction of the first magnetic element 602 and a magnetization direction of the second magnetic element 608 may be between 0° and 180°. In some embodiments, the angle between the magnetization direction of the first magnetic element 602 and the magnetization direction of the second magnetic element 608 may be between 45° and 135°. In some embodiments, the angle between the magnetization direction of the first magnetic element 602 and the magnetization direction of the second magnetic element 608 may be not greater than 90°.

In some embodiments, at a position of the second magnetic element 608, an angle between a direction of the first full magnetic field and the magnetization direction of the second magnetic element 608 may be not greater than 90°. In some embodiments, at the position of the second magnetic element 608, an angle between the direction of the magnetic field generated by the first magnetic element 602 and the magnetization direction of the second magnetic element 608 may be equal to or less than 90°, such as 0°, 10°, 20°, etc. As another example, the magnetization direction of the first magnetic element 602 may vertically upwards and be perpendicular to the lower surface or the upper surface of the first magnetic element 602 (as indicated by the arrow a in FIG. 24). The magnetization direction of the second magnetic element 608 may be from an outer ring of the second magnetic element 608 to an inner ring of the second magnetic element 608 (as indicated by the arrow c in FIG. 24, that is, on a right side of the first magnetic element 602, the magnetization direction of the first magnetic element 602 may be deflected by 270° in the clockwise direction). Compared with a magnetic circuit assembly of a single magnetic element, the first full magnetic field changing element 606 of the magnetic circuit assembly 3100 may increase a total magnetic flux in the magnetic gap in the magnetic circuit assembly 2100, thereby increasing the magnetic induction intensity in the magnetic gap. In addition, under the action of the first full magnetic field changing element 606, originally diverging magnetic lines of force may converge to the position of the magnetic gap, further increasing the magnetic induction intensity in the magnetic gap.

Figure 25:
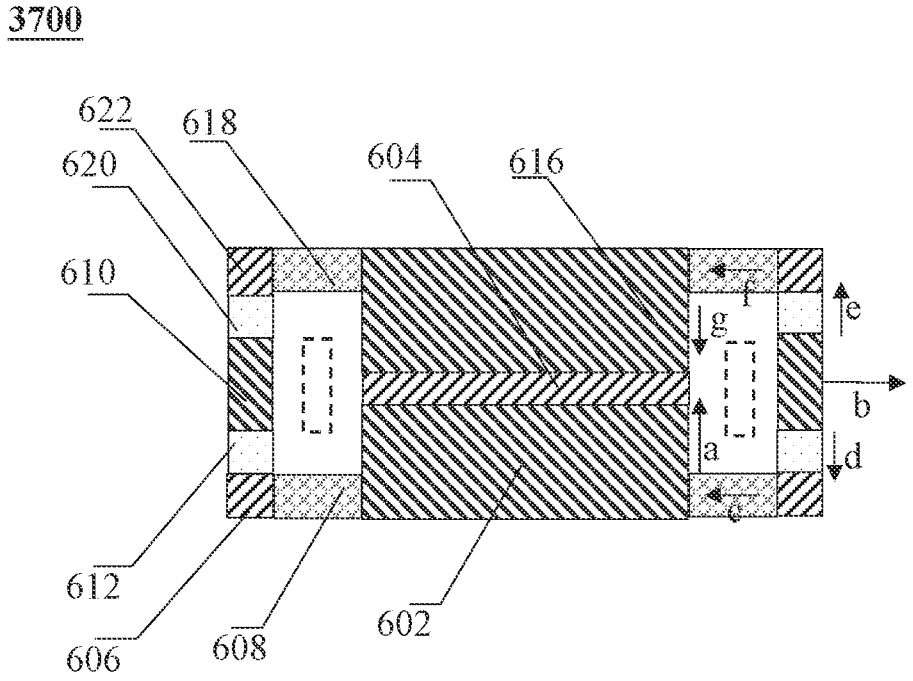
FIG. 25 is a schematic diagram illustrating a longitudinal cross-sectional of an exemplary speaker device according to some embodiments of the present disclosure.

FIG. 25 is a schematic diagram illustrating a longitudinal cross-section of an exemplary speaker device according to some embodiments of the present disclosure. As shown in FIG. 25, a magnetic circuit assembly 3700 may include a first magnetic element 602, a first magnetically conductive element 604, a first full magnetic field changing element 606, a second magnetic element 608, and a third magnetic element 610, a fourth magnetic element 612, a fifth magnetic element 616, a sixth magnetic element 618, a seventh magnetic element 620, and a second ring element 622. In some embodiments, the first full magnetic field changing element 606 and/or the second ring element 622 may include a ring magnetic element or a ring magnetically conductive element.

In some embodiments, the ring magnetic element may one or more magnetic materials described in the present disclosure, and the ring magnetically conductive element may include one or more magnetically conductive materials described in the present disclosure. In some embodiments, the magnetic circuit assembly described in the above embodiments may refer to a structure that provides a magnetic field. In some embodiments, the magnetic elements described in the present disclosure may refer to an element of energy storage, energy conversion, and electrical isolation. In some embodiments, the magnetically conductive element may refer to an element configured to form a magnetic field loop.

In some embodiments, the sixth magnetic element 618 may be connected to the fifth magnetic element 616 and the second ring element 622, and the seventh magnetic element 620 may be connected to the third magnetic element 610 and the second ring element 622. In some embodiments, the first magnetic element 602, the fifth magnetic element 616, the second magnetic element 608, the third magnetic element 610, the fourth magnetic element 612, the sixth magnetic element 618, and/or the seventh magnetic element 620 and the first magnetically conductive element 604, the first full magnetic field changing element 606, and the second ring element 622 may form a magnetic circuit.

In some embodiments, an angle between a magnetization direction of the first magnetic element 602 and the magnetization direction of the sixth magnetic element 618 may be between 0° and 180°. In some embodiments, the angle between the magnetization direction of the first magnetic element 602 and the magnetization direction of the sixth magnetic element 618 may be between 45° and 135°. In some embodiments, the angle between the magnetization direction of the first magnetic element 602 and the magnetization direction of the sixth magnetic element 618 may be not greater than 90°. In some embodiments, the magnetization direction of the first magnetic element 602 may be perpendicular to a lower surface or an upper surface of the first magnetic element 602 (as indicated by the arrow a in FIG. 25), and the magnetization direction of the sixth magnetic element 618 may be from an outer ring of the magnetic element 618 to an inner ring of the sixth magnetic element 618 (as indicated by the arrow f FIG. 25, that is, on a right side of the first magnetic element 602, the magnetization direction of the first magnetic element 602 may be deflected by 270° in the clockwise direction). In some embodiments, in a same vertical direction, the magnetization direction of the sixth magnetic element 618 and the magnetization direction of the second magnetic element 608 may be the same. In some embodiments, the magnetization direction of the first magnetic element 602 may be perpendicular to the lower or upper surface of the first magnetic element 602 (as indicated by the arrow a in FIG. 25), and the magnetization direction of the seventh magnetic element 620 may be from the lower surface of the seventh magnetic element 620 to the upper surface of the seventh magnetic element 620 (as indicated by the arrow e in FIG. 25, that is, on the right side of the first magnetic element 602, the magnetization direction of the first magnetic element 602 may be deflected 360° in the clockwise direction). In some embodiments, the magnetization direction of the seventh magnetic element 620 and the magnetization direction of the fourth magnetic element 612 may be the same.

In some embodiments, at a position of the sixth magnetic element 618, an angle between a direction of the magnetic field generated by the magnetic circuit assembly 3700 and the magnetization direction of the sixth magnetic element 618 may be not greater than 90°. In some embodiments, at the position of the sixth magnetic element 618, an angle between a direction of the magnetic field generated by the first magnetic element 602 and the magnetization direction of the sixth magnetic element 618 may be less than or equal to 90°, such as 0°, 10°, 20°, etc.

In some embodiments, an angle between the magnetization direction of the first magnetic element 602 and a magnetization direction of the seventh magnetic element 620 may be between 0° and 180°. In some embodiments, the angle between the magnetization direction of the first magnetic element 602 and the magnetization direction of the seventh magnetic element 620 may be between 45° and 135°. In some embodiments, the angle between the magnetization direction of the first magnetic element 602 and the magnetization direction of the seventh magnetic element 620 may be not greater than 90°.

In some embodiments, at a position of the seventh magnetic element 620, an angle between the direction of the magnetic field generated by the magnetic circuit assembly 3700 and the magnetization direction of the seventh magnetic element 620 may be not greater than 90°. In some embodiments, at the position of the seventh magnetic element 620, the angle between the direction of the magnetic field generated by the first magnetic element 602 and the magnetization direction of the seventh magnetic element 620 may be less than or equal to 90°, such as 0°, 10°, 20°, etc.

In some embodiments, the first full magnetic field changing element 606 may be a ring magnetic element. In this case, the magnetization direction of the first full magnetic field changing element 606 may be the same as the magnetization direction of the second magnetic element 608 or the fourth magnetic element 612. For example, on the right side of the first magnetic element 602, the magnetization direction of the first full magnetic field changing element 606 may be from an outer ring of the first full magnetic field changing element 606 to an inner ring of the first full magnetic field changing element 606. In some embodiments, the second ring element 622 may be an ring magnetic element. In this case, a magnetization direction of the second ring element 622 may be the same as the magnetization direction of the sixth magnetic element 618 or the seventh magnetic element 620. For example, on the right side of the first magnetic element 602, the magnetization direction of the second ring element 622 may be from the outer ring of the second ring element 622 to the inner ring of the second ring element 622. In the magnetic circuit assembly 3700, one or more magnetic elements may increase the total magnetic flux. The interaction between different magnetic elements may prevent the leakage of magnetic lines, increase the magnetic induction intensity at the magnetic gap, and improve the sensitivity of the speaker device.

In some embodiments, based on the magnetic circuit assembly 3700, a magnetic circuit assembly may further include a magnetic conductive cover. The magnetic conductive cover may include one or more magnetic materials described in the present disclosure, e.g., low carbon steel, silicon steel sheet, silicon steel sheet, ferrite, etc. The magnetic conductive cover may be connected to the first magnetic element 602, the first full magnetic field changing element 606, the second magnetic element 608, the third magnetic element 610, the fourth magnetic element 612, the fifth magnetic element 616, the sixth magnetic element 618, the seventh magnetic element 620, and/or the second ring element 622 via one or more connection manners described in the present disclosure. In some embodiments, the magnetic conductive cover may include at least one bottom plate and a side wall, and the side wall may have a ring structure. In some embodiments, the bottom plate and the side wall may be integrally formed. In some embodiments, the bottom plate may be connected to the side wall via or more connection manners described in the present disclosure. For example, the magnetic conductive cover may include a first bottom plate, a second bottom plate, and the side wall. The first bottom plate and the side wall may be integrally formed, and the second bottom plate may be connected to the side wall via one or more connection manners described in the present disclosure.

In the magnetic circuit assembly 3100, the magnetic conductive cover may close the magnetic circuit generated by the magnetic circuit assembly 3100, so that relatively more magnetic induction lines may be concentrated in the magnetic gap in the magnetic circuit assembly 3100 to suppress magnetic leakage, increase the magnetic induction intensity in the magnetic gap, and improve the sensitivity of the speaker device.

It should be noted that a magnetic circuit assembly described in the above embodiments may refer to a structure that provides a magnetic field.

In some embodiments, based on the magnetic circuit assembly 3100, a magnetic circuit assembly may further include one or more conductive elements (e.g., a first conductive element, a second conductive element, a third conductive element, etc.). More descriptions regarding the conductive element(s) may be similar to that of the conductive element 218, the conductive element 220, and the conductive element 222, and the related descriptions are not repeated here.

Figure 26:
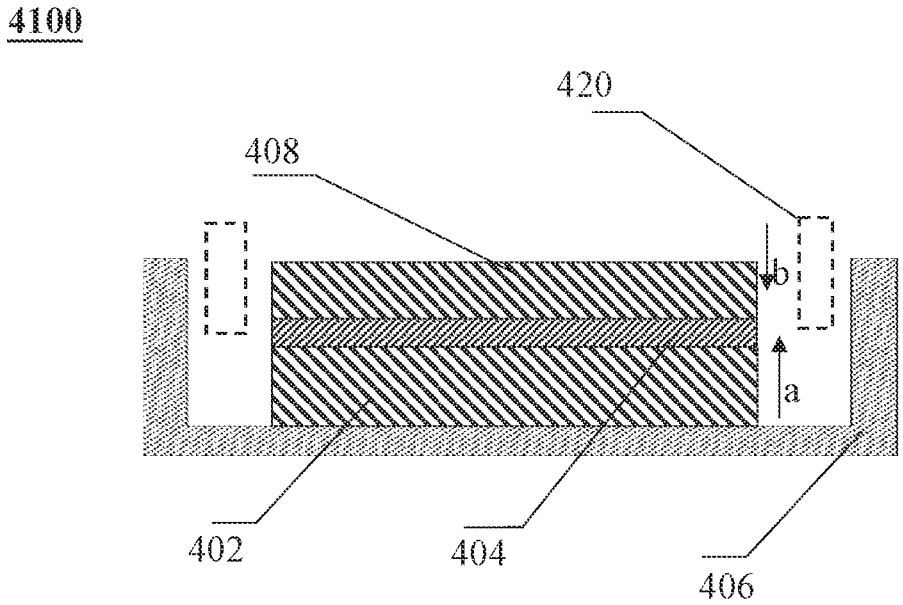
FIG. 26 is a schematic diagram illustrating a longitudinal cross-sectional of an exemplary magnetic circuit assembly according to some embodiments of the present disclosure.

FIG. 26 is a schematic diagram illustrating a longitudinal cross-sectional of an exemplary magnetic circuit assembly according to some embodiments of the present disclosure. As shown in FIG. 26, the magnetic circuit assembly 4100 may include a first magnetic element 402, a first magnetically conductive element 404, a second magnetically conductive element 406, and a second magnetic element 408.

It should be noted that the magnetic circuit assembly described in the above embodiments may refer to a structure that provides a magnetic field. The magnetic element described in the above embodiments may refer to an element of energy storage, energy conversion, and electrical isolation. The magnetically conductive element may refer to an element configured to form a magnetic field loop.

In some embodiments, the first magnetic element 402 and/or the second magnetic element 408 may include one or more magnets described in the present disclosure. In some embodiments, the first magnetic element 402 may include a first magnet, and the second magnetic element 408 may include a second magnet. The first magnet and the second magnet may be the same or different. The first magnetically conductive element 404 and/or the second magnetically conductive element 406 may include one or more magnetically conductive element materials described in the present disclosure. A processing manner of the first magnetically conductive element 404 and/or the second magnetically conductive element 406 may include one or more processing manners described in the present disclosure. In some embodiments, the first magnetic element 402, the first magnetically conductive element 404, and/or the second magnetic element 408 may include an axisymmetric structure. For example, the first magnetic element 402, the first magnetically conductive element 404, and/or the second magnetic element 408 may be cylindrical. In some embodiments, the first magnetic element 402, the first magnetically conductive element 404, and/or the second magnetic element 408 may be coaxial cylinders with the same or different diameters. A thickness of the first magnetic element 402 may be greater than or equal to the thickness of the second magnetic element 408. In some embodiments, the second magnetically conductive element 406 may include a groove-type structure. In some embodiments, the groove-shaped structure may include a U-shaped cross-section, and the groove-shaped second magnetically conductive element 406 may include a bottom plate and a side wall. In some embodiments, the bottom plate and the side wall may be integrally formed. For example, the side wall may be formed by extending the bottom plate in a direction perpendicular to the bottom plate. In some embodiments, the bottom plate may be connected to the side wall via one or more connection manners described according to some embodiments of the present disclosure. A shape of the second magnetic element 408 may include a ring, a sheet, etc. More descriptions regarding the shape of the second magnetic element 408 may be found elsewhere in the present disclosure. In some embodiments, the second magnetic element 408 may be coaxial with the first magnetic element 402 and/or the first magnetically conductive element 404.

Further, an upper surface of the first magnetic element 402 may be connected to a lower surface of the first magnetically conductive element 404. A lower surface of the first magnetic element 402 may be connected to the bottom plate of the second magnetically conductive element 406. A bottom surface of the second magnetic element 408 may be connected to the side wall of the second magnetically conductive element 406. The connection between the first magnetic element 402, the first magnetically conductive element 404, the second magnetically conductive element 406, and/or the second magnetic element 408 may include a bonding connection, a clamping connection, a welding connection, a riveting connection, a bolting connection, or the like, or any combination thereof.

In some embodiments, a magnetic gap may be formed between side walls of the first magnetic element 402 and/or the first magnetically conductive element 404 and/or the second magnetic element 408 and the second magnetically conductive element 406. The voice coil may be disposed in the magnetic gap. In some embodiments, the first magnetic element 402, the first magnetically conductive element 404, the second magnetically conductive element 406, and the second magnetic element 408 may form a magnetic circuit. In some embodiments, the magnetic circuit assembly 4100 may generate a first full magnetic field, and the first magnetic element 402 may generate a second magnetic field. The first full magnetic field may be formed by magnetic fields generated by one or more components (e.g., the first magnetic element 402, the first magnetically conductive element 404, the second magnetically conductive element 406, and/or the second magnetic element 408) of the magnetic circuit assembly 4100. In some embodiments, a magnetic field intensity (also referred to as a magnetic induction or a magnetic flux density) of the first full magnetic field in the magnetic gap may be greater than a magnetic field intensity of the second magnetic field in the magnetic gap. In some embodiments, the second magnetic element 408 may generate a third magnetic field, which may improve the magnetic field intensity of the first full magnetic field at the magnetic gap.

In some embodiments, an angle between a magnetization direction of the second magnetic element 208 and a magnetization direction of the first magnetic element 402 may be between 90° and 180°. In some embodiments, the angle between the magnetization direction of the second magnetic element 408 and the magnetization direction of the first magnetic element 402 may be between 150° and 180°. In some embodiments, the magnetization direction of the second magnetic element 408 may be opposite to the magnetization direction of the first magnetic element 402 (as indicated by the arrows a and b).

Compared with a magnetic circuit assembly of a single magnetic element, the magnetic circuit assembly 4100 may include the second magnetic element 408. The magnetization direction of the second magnetic element 408 may be opposite to the magnetization direction of the first magnetic element 402, thereby reducing the magnetic leakage of the first magnetic element 402 in the magnetization direction, suppressing the magnetic field generated by the first magnetic element 402 into the magnetic gap, and increasing the magnetic induction intensity in the magnetic gap.

It should be noted that the above descriptions regarding the speaker device are only some specific examples and should not be regarded as the only feasible implementations. Obviously, for those skilled in the art, after understanding the basic principle of the speaker device, it is possible to make various modifications and changes in forms and details to the implementation mode of the speaker device. However, those variations, changes, and modifications do not depart from the scope of the present disclosure. For example, the magnetic elements in the magnetic circuit assembly are not limited to the above-mentioned first magnetic element, second magnetic element, third magnetic element, fourth magnetic element, fifth magnetic element, sixth magnetic element, and seventh magnetic element. A count (or a number) of the magnetic elements may be increased or decreased. Such variations are all within the protection scope of the present disclosure.

In some embodiments, the speaker device described above may transmit sound to the user through air conduction. When the sound is transmitted via an air conduction mode, the speaker device may include one or more sound sources. The sound source may be located at a specific position of a user's head, for example, the top of the head, forehead, cheek, sideburns, auricle, back of the auricle, etc., which may not block or cover the ear canal of the user. For illustration purposes, FIG. 27 is a schematic diagram illustrating an exemplary sound transmission through air conduction according to some embodiments of the present disclosure.

Figure 27:
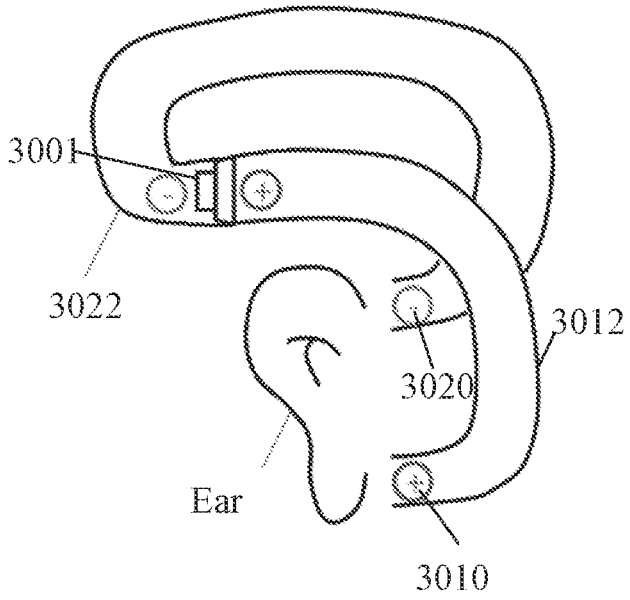
FIG. 27 is a schematic diagram illustrating an exemplary sound transmission through air conduction according to some embodiments of the present disclosure.

As shown in FIG. 27, a sound source 3010 and a sound source 3020 may generate sound waves with opposite phases ("+" and "−" in FIG. 27 indicate opposite phases). For brevity, the sound source mentioned here refers to the sound outlet on the speaker device that outputs sound. For example, the sound source 3010 and the sound source 3020 may be located at specific positions (e.g., the housing 20 or the supporting connector 10) of the speaker device.

In some embodiments, the sound source 3010 and the sound source 3020 may be generated by a same vibration device 3001. The vibration device 3001 may include a diaphragm (not shown in the figure). When the diaphragm is driven by an electrical signal to vibrate, a front of the diaphragm may drive the air to vibrate, and the sound source 3010 may be formed at a sound outlet through a sound guide channel 3012, and a back of the diaphragm may also drive the air to vibrate, and the sound source 3020 may be formed at another sound outlet through a sound guide channel 3022. The sound guide channel refers to a sound propagation route from the diaphragm to a corresponding sound outlet. In some embodiments, the sound guide channel is a route enclosed by a specific structure (e.g., the housing 20 or the supporting connector 10) on a speaker device. It should be understood that, in some alternative embodiments, the sound source 3010 and the sound source 3020 may be generated by different vibration devices and generated by different diaphragms.

A portion of sounds generated by the sound source 3010 and the sound source 3020 may be transmitted to the user's ears to form a sound heard by the user, and another portion of the sounds may be transmitted to the environment to form a sound leakage. Considering that the sound source 3010 and the sound source 3020 are relatively close to the user's ears, for the convenience of description, the sound transmitted to the user's ears may be called a near-field sound, and the leakage sound transmitted to the environment may be called a far-field sound. In some embodiments, the near-field/far-field sound with different frequencies generated by the speaker device may be related to a distance between the sound source 3010 and the sound source 3020. Generally speaking, the near-field sound produced by the speaker device may be increased with increasement of the distance between the two sound sources, and the far-field sound (sound leakage) produced by the speaker device may be increased with increasement of the frequency.

For sounds with different frequencies, the distance between the sound source 3010 and the sound source 3020 may be determined so that a low-frequency near-field sound (e.g., a sound with a frequency less than 800 Hz) generated by the speaker device may be increased, and a high-frequency far-field sound (e.g., a sound with a frequency greater than 2000 Hz) may be reduced. In order to achieve the above purpose, the speaker device may include two or more dual sound source groups, and each dual sound source group may include two sound sources similar to the sound source 3010 and the sound source 3020 and may generate sounds with specific frequencies, respectively. Specifically, a first group of the dual sound source groups may be configured to generate a low frequency sound, and a second group of the dual sound source groups may be configured to generate a high frequency sound. In order to obtain a relatively large low-frequency near-field sound, the distance between the two sound sources in the first group may be set to a relatively large value. Due to that the low-frequency signal has a long wavelength, the relatively large distance between the two sound sources may not form an excessive phase difference in the far field, and may not cause too much sound leakage in the far field. In order to make the high-frequency far-field sound relatively small, the distance between the two sound sources in the second group of the dual sound source groups may be set to a relatively small value. Due to the short wavelength of the high-frequency signal, the relatively small distance between the two sound sources may avoid the formation of a relatively large phase difference in the far field, and avoid the formation of relatively large sound leakage. The distance between the dual sound source of the second group may be smaller than the distance between the dual sound source of the first group.

According to the speaker device disclosed in the present disclosure, one or more beneficial effects may be realized.

The one or more beneficial effects include: (1) a position of a button on the speaker device may be optimized, and the vibration efficiency of the speaker device may be improved; (2) the sound transmission efficiency of the speaker device may be improved and the volume may be increased; (3) the sound quality of the speaker device may be improved by adjusting an angle θ between a normal line A of a panel or a normal line A' of a contact surface of the panel and the human skin and a straight line B where a driving force of the speaker device locates; (4) the sensitivity of the speaker device may be improved by adding a magnetic element, a magnetically conductive element, and a conductive element in the magnetic circuit assembly. It should be noted that different embodiments may have different beneficial effects. In different embodiments, the beneficial effects may include any of the beneficial effects mentioned above or any other beneficial effects that may be realized.

Having thus described the basic concepts, it may be rather apparent to those skilled in the art after reading this detailed disclosure that the foregoing detailed disclosure is intended to be presented by way of example only and is not limiting. Various alterations, improvements, and modifications may occur and are intended to those skilled in the art, though not expressly stated herein. These alterations, improvements, and modifications are intended to be suggested by this disclosure and are within the spirit and scope of the exemplary embodiments of this disclosure.

Moreover, certain terminology has been used to describe embodiments of the present disclosure. For example, the terms "one embodiment," "an embodiment," and "some embodiments" mean that a particular feature, structure, or characteristic described in connection with the embodiment is included in at least one embodiment of the present disclosure. Therefore, it is emphasized and should be appreciated that two or more references to "an embodiment" or "one embodiment" or "an alternative embodiment" in various portions of this specification are not necessarily all referring to the same embodiment. Furthermore, the particular features, structures, or characteristics may be combined as suitable in one or more embodiments of the present disclosure.

Further, it will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, micro-code, etc.) or combining software and hardware implementation that may all generally be referred to herein as a "unit," "module," or "system." Furthermore, aspects of the present disclosure may take the form of a computer program product embodied in one or more computer readable media having computer-readable program code embodied thereon.

Furthermore, the recited order of processing elements or sequences, or the use of numbers, letters, or other designations therefore, is not intended to limit the claimed processes and methods to any order except as may be specified in the claims. Although the above disclosure discusses through various examples what is currently considered to be a variety of useful embodiments of the disclosure, it is to be understood that such detail is solely for that purpose and that the appended claims are not limited to the disclosed embodiments, but, on the contrary, are intended to cover modifications and equivalent arrangements that are within the spirit and scope of the disclosed embodiments.

Similarly, it should be appreciated that in the foregoing description of embodiments of the present disclosure, various features are sometimes grouped together in a single embodiment, figure, or description thereof for the purpose of streamlining the disclosure aiding in the understanding of one or more of the various embodiments. This method of disclosure, however, is not to be interpreted as reflecting an intention that the claimed subject matter requires more features than are expressly recited in each claim. Rather, claim subject matter lies in less than all features of a single foregoing disclosed embodiment.

In some embodiments, the numbers expressing quantities or properties used to describe and claim certain embodiments of the application are to be understood as being modified in some instances by the term "about," "approximate," or "substantially." For example, "about," "approximate," or "substantially" may indicate a certain variation (e.g., ±1%, ±5%, ±10%, or ±20%) of the value it describes, unless otherwise stated. Accordingly, in some embodiments, the numerical parameters set forth in the written description and attached claims are approximations that may vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the application are approximations, the numerical values set forth in the specific examples are reported as precisely as practicable. In some embodiments, a classification condition used in classification is provided for illustration purposes and modified according to different situations. For example, a classification condition that "a probability value is greater than the threshold value" may further include or exclude a condition that "the probability value is equal to the threshold value."

We claim:

1. A speaker device, comprising a circuit housing, an ear hook, a rear hook, and a speaker assembly, wherein the circuit housing is configured to accommodate a control circuit or a battery;

the ear hook is connected to a first end of the circuit housing;

the rear hook is connected to a second end of the circuit housing; and the speaker assembly is connected to an end of the ear hook, the speaker assembly includes a headphone core and a housing for accommodating the headphone core, the housing includes a housing panel facing a human body and a housing back opposite to the housing panel, the headphone core causes the housing panel and the housing back to vibrate, a vibration of the housing panel has a first phase, a vibration of the housing back has a second phase, and an absolute value of a difference between the first phase and the second phase is less than 90 degrees when a frequency of each of the vibration of the housing panel and the vibration of the housing back is between 1000 Hz and 4000 Hz.

2. The speaker device of claim 1, wherein the absolute value of the difference between the first phase and the second phase is less than 90 degrees when the frequency of each of the vibration of the housing panel and the vibration of the housing back is between 1000 Hz and 2000 Hz.

3. The speaker device of claim 1, wherein the vibration of the housing panel has a first amplitude, the vibration of the housing back has a second amplitude; and a ratio of the first amplitude to the second amplitude is within a range of 0.5 to 1.5.

4. The speaker device of claim 1, wherein the vibration of the housing panel generates a first sound leakage wave, the vibration of the housing back generates a second sound leakage sound wave, and the first sound leakage wave and the second sound leakage wave have an overlap, which reduces an amplitude of the first sound leakage wave.

5. The speaker device of claim 1, wherein the housing panel and one or more other components of the housing are connected via at least one of a bonding connection, a snaping connection, a welding connection, or a threaded connection.

6. The speaker device of claim 1; wherein at least one of the housing panel or the housing back is made of fiber reinforced plastic material.

7. The speaker device of claim 1, wherein the vibration caused by the headphone core generates a driving force;

the housing panel is connected to the headphone core via a transmission connection mode;

at least a portion of the housing panel is connected or against the human body such that a sound is conducted;

an area of the housing panel contacted or against the human body includes a normal line; a line where the driving force locates being not parallel to the normal line.

8. The speaker device of claim 7, wherein a positive direction of the line where the driving force locates is set outwards the speaker device from the housing panel, a positive direction of the normal line is set outwards the speaker device, and an angle formed between the line where the driving force locates along the positive direction of the line and the normal line along the positive direction of the normal line is an acute angle.

9. The speaker device of claim 7, wherein the headphone core includes a coil and a magnetic circuit component, axes of the coil and the magnetic circuit component are not parallel to the normal line, and the axes of the coil and the magnetic circuit component are perpendicular to a radial plane of the coil or a radial plane of the magnetic circuit component.

10. The speaker device of claim 7, wherein the driving force has a component in a first quadrant and/or a third quadrant of an XOY plan coordinate system, the origin of the XOY plan coordinate system is located on a contact surface between the speaker device and the human body, an X-axis of the XOY plan coordinate system is parallel to a coronal axis of the human body, a Y-axis is parallel to a sagittal axis of the human body, and a positive direction of the X-axis faces outside of the human body, and a positive direction of the Y-axis faces the front of the human body.

11. The speaker device of claim 7, wherein the area of the housing panel connected or against the human body includes a plane or a quasi-plane.

12. The speaker device of claim 1, wherein the headphone core further includes a magnetic circuit assembly, the magnetic circuit assembly generating a first magnetic field, the magnetic circuit assembly includes a first magnetic element, a first magnetically conductive element, at least one second magnetic element, the first magnetic element generates a second magnetic field, the at least one second magnetic element surrounds the first magnetic element, a magnetic gap is formed between the first magnetic element and the at least one second magnetic element, and an intensity of the first magnetic field in the magnetic gap is greater than an intensity of the second magnetic field in the magnetic gap.

13. The speaker device of claim 12, further comprising a second magnetically conductive element and at least one third magnetic element, wherein the at least one third magnetic element is connected to the second magnetically conductive element and the at least one second magnetic element.

14. The speaker device of claim 13 further comprising at least one fourth magnetic element, wherein the at least one fourth magnetic element is disposed below the magnetic gap and connected to the first magnetic element and the second magnetically conductive element.

15. The speaker device of claim 13, wherein the first magnetically conductive element is connected to an upper surface of the first magnetic element, the second magnetically conductive element includes a bottom plate and a side wall, and the first magnetic element is connected to the bottom plate of the second magnetically conductive element.

16. The speaker device of claim 13, further comprising at least one conductive element, wherein the at least one conductive element is connected to at least one of the first magnetic element, the first magnetically conductive element, or the second magnetically conductive element.

17. The speaker device of claim 12, further comprising at least one fifth magnetic element, wherein the at least one fifth magnetic element is connected to an upper surface of the first magnetically conductive element.

18. The speaker device of claim 17, further comprising a third magnetically conductive element, wherein the third magnetic element is connected to an upper surface of the fifth magnetic element and configured to suppress field intensity leakage of the first magnetic field.

* * * * *